US005906092A

United States Patent [19]

Hattori

[11] Patent Number: 5,906,092

[45] Date of Patent: May 25, 1999

[54] SPINNING MACHINE WITH SPINDLE MOTOR CONTROL SYSTEM

[76] Inventor: Motonobu Hattori, 3-26-19, Mitsuwadai, Wakaba-ku, Chiba-shi, Chiba-ken, Japan

[21] Appl. No.: 08/855,891

[22] Filed: May 12, 1997

[30] Foreign Application Priority Data

May 11, 1996 [JP] Japan ..... 8-152828
Mar. 8, 1997 [JP] Japan ..... 9-070674

[51] Int. Cl.[6] ..... D01H 13/00

[52] U.S. Cl. ..... 57/100; 57/78; 57/88; 57/264

[58] Field of Search ..... 57/100, 78, 88, 57/89, 264

[56] References Cited

U.S. PATENT DOCUMENTS

| | | | |
|---|---|---|---|
| 2,138,658 | 11/1938 | Hongo | 57/100 |
| 3,116,591 | 1/1964 | Muller | 57/88 |
| 3,118,271 | 1/1964 | Higgs et al. | 57/88 |
| 3,122,875 | 3/1964 | Swift et al. | 57/88 |
| 4,931,705 | 6/1990 | Wieczorek | 318/49 |
| 5,161,361 | 11/1992 | Talley et al. | 57/100 |
| 5,572,859 | 11/1996 | Derichs et al. | 57/78 |

FOREIGN PATENT DOCUMENTS

| | | | |
|---|---|---|---|
| 3727940 | 12/1988 | Germany . | |
| 3727939 | 3/1989 | Germany . | |
| 3942914 | 6/1991 | Germany | 57/100 |
| 63-21930 | 1/1988 | Japan . | |
| 2160930 | 6/1990 | Japan . | |
| 3260098 | 11/1991 | Japan . | |

*Primary Examiner*—William Stryjewski
*Attorney, Agent, or Firm*—Sughrue, Mion, Zinn, Macpeak & Seas, PLLC

[57] ABSTRACT

The object of the invention is to provide a spinning machine which the manufacturing expenses and maintenance/checkout expenses are held down and the operation of the low voltage circuits is stabilized. In a spinning machine having a spindle motor control system, each three-phase power supply line is provided with a pair of conductive contacts electrically connected to at least two phases on the way thereof, and the pair of conductive contacts are structured to be separated when inserting an insulating unit therebetween and to come in contact with each other again when pulling out the insulating unit.

21 Claims, 26 Drawing Sheets

SPINNING MACHINE WITH SPINDLE MOTOR CONTROL SYSTEM

TECHNICAL FIELD TO WHICH THE INVENTION BELONGS

The present invention relates to a spinning machine having a spindle motor control system (hereinafter, simply referred to as "spinning machine"). The present invention, more particularly, relates to a spinning machine which at least temporarily stops the rotation of a spindle for drawing long and narrow fibers from a lump of natural fiber or synthetic fiber or raw stock before the formation of fiber (hereinafter, these are referred to as "fiber lump") and twisting the drawn fibers.

RELATED BACKGROUND ART

Referring to FIGS. 26 through 33, a ring spinning frame as one of spinning machine will be described. The ring spinning frame is used in a spinning process, the final stage in the spinning process for making yarn from a fiber lump. FIG. 26 is an entire perspective view the spinning frame 1, FIG. 27 is a view showing a bobbin 9*b* of a spindle unit 8 and a full bobbin 18, FIG. 28 is a view of a spindle 9*s* taken from the above, FIG. 29 is an enlarged view of main components of a individual stop control unit 13, FIG. 30 is a view taken in the direction of arrows substantially along the line V—V of FIG. 29, FIG. 31 is a view showing a state where the full bobbin 18 is pulled out of the spindle blade 9*s*, FIG. 32 is a view showing the full bobbin 18 and the spindle blade 9*s* covered by the bobbin 9*b*, and FIG. 33 is a virtual sectional view taken in the direction of arrows substantially along the line VIII—VIII of FIG. 31.

As shown in FIG. 26, the ring spinning frame 1 is generally structured as follows. That is, the ring spinning frame 1 mainly comprises a roving unit 3 positioned at the top thereof and having a plurality of rovings 3*r* as fiber lumps, a draft unit 5 positioned just below the roving unit 3, a snail wire unit (guiding member) 7 for introducing the yarns 6 from the drift unit 5, a spindle unit 8 positioned for winding the yarns 6, introduced by the snail wire unit 7, from the underside, a spindle motor unit (driving member) 11 for driving the spindle unit 8 from the underside, and a individual stop control unit 13 (hereinafter, simply referred to as "control unit") for individually stopping respective spindle motors. It should be understood that the number of members are the same to correspond to each other unless description will be specifically made because all of the number of the rovings 3*r*, the number of components of the draft unit 5, and the number of components of the snail wire unit 7 are the same (6 in this example).

The roving unit 3 is structured as follows. That is, the roving unit 3 comprises a creel C composed of supporting poles arranged in parallel with each other and 6 rovings 3*r*, 3*r*, . . . which are suspended from the creel C. Yarns pulled from the rovings 3*r* are extended to the draft unit 5 via a guiding rod 14. The draft unit 5 comprises a plurality of roller groups 5*r*, which each comprise a back roller $\mathbf{5}r_1$, a middle roller $\mathbf{5}r_2$, and a front roller $\mathbf{5}r_3$. The surface velocity ratio of the rollers $\mathbf{5}r_1$, $\mathbf{5}r_2$, $\mathbf{5}r_3$ is set, for example, to 1:2:20. This allows the roving 3*r* to be drafted and gives a predetermined size, great strength, and elasticity to the roving 3*r*.

The snail wire unit 7 is structured as follows. That is, the snail wire unit 7 comprises spiral-wound wires 7*w* and a supporting rod 7*s* onto which the wires 7*w* are disposed. The respective wires 7*w* are positioned corresponding and just below the respective roller groups 5*r*. The respective yarns 6 from the draft unit 5 are passed through the respective wires 7*w* so as to prevent the adjacent yams from interlocking.

The spindle unit 8 comprises a plurality of spindles 9. Each spindle 9 is structured as follows. Each spindle 9 generally comprises a spindle blade 9*s* as a pole-like rotator (see FIG. 31 and FIG. 33), a bobbin 9*b* covering the spindle blade 9*s* and onto which the yarn 6 is wound, a ring-like traveler 15 which slides around the bobbin 9*b* to twist the yarn 6 delivered from snail wire unit 7, and a ring 17 guiding the traveler 15. The traveler 15 is, as shown in FIG. 28, structured as to slide around the bobbin 9*b* to wind the twisted yarn 6 onto the bobbin 9*b*. In FIGS. 27 and 28, the reference numeral 18 designates a full bobbin which is made of yarn wound onto the bobbin 9*b*. FIGS. 31 and 32 show the state where the full bobbin 18 is pulled out of the spindle blade 9*s* and the state where the spindle blade 9*s* is covered by another bobbin 9*b* to make another fill bobbin 18, respectively.

It should be noted that the spindle blade 9*s* is rotatably supported to a bolster 11*b* (described later) via an insert 9*i*. The insert 9*i* is disposed to dissipate vibration energy of the spindle blade 9*s*. Disposed around a lower surface of the spindle blade 9*s* is a rotor 9*r* corresponding to the spindle motor unit 11.

In FIG. 26, the reference numeral 19*a* designates respective anti-node rings. Each anti-node ring is positioned above the spindle 9 to stabilize the yarn 6. The reference numeral 19*b* designates a ring rail. The ring rail 19*b* is a plate member for supporting the rings 17. The ring rail 19*b* have, in the longitudinal direction, a plurality of through holes (not shown), into which the spindles 9 are inserted, respectively.

The spindle motor unit 11 comprises, as shown in FIGS. 26 and 27, a plurality of spindle motors 12. The spindle motors 12 supported by a spindle rail 20 are disposed directly to the spindles 9, respectively. That is, incorporated in each spindle motor 12 is a stator 12*s* onto which a primary winding is wound in a box-like hollow casing 12*c*. As stated above, the rotor 9*r* corresponds to the stator 12*s*. As shown in FIG. 26, the control unit 13 is actuated by operating each switch 11*s* so as to stop or restart the corresponding spindle motor 12.

The control unit 13 is structured as follows. That is, the control unit 13 comprises, as shown in FIG. 29, a duct 21 as a casing having dust-proof and waterproof structure, a plurality of control circuit substrates 23 incorporated in the duct 21, and a plurality of power line substrates 25. Connected to the power line substrates 25 is an output of an inverter power source 26 disposed out of the control unit 13 via a power supply line 32 surfaced by a coating. A low-voltage signal line and low-voltage power supplying line 29 is also connected to the power line substrates 25 to supply low voltage to the control circuit substrates 23. It should be noted that the reference numeral 31 in FIG. 29 designates a power connecting line for connecting the control unit 13 to another control unit 13.

The operating state of the ring spinning frame will be described according to FIGS. 31 through 33. The spindle motors 12 are powered and driven by the inverter power source. The drive of the spindle motors 12 allow the spindles 19*s* integrated with the spindle motors 12 to rotate and therefore allow the bobbins 9*b* to rotate. The travelers 15 on the rings 17 are pulled by yarns 6 about to be wound onto the bobbins 9*b* so as to start to revolve at nearly the same speed as the bobbins 9*b* (spindles 9*s*). At this time, rotational differences between the bobbins 9*b* (spindles 9*s*) and the travelers 15 allow the yarns 6 to be wound onto the bobbins 9*b*. The speed of letting off the yarns 6 from the front rollers $5r_3$ is the same as the speed of winding the yarns onto the bobbins 9*b*. In addition, one twist of the yarn 6 is produced by one revolution of the traveler 15.

By the way, as shown in FIGS. 31 and 32, the yam 6 sometimes snaps during forming the full bobbin 18 between the snail wire unit 7 and the spindle unit 8 or between the draft unit 5 and the snail wire unit 7. One cause of yarn snapping is that the rotation of the spindle is unsuitable so that the extra force is exerted onto the yarn 6. The aforementioned problems are not limited to the ring spinning frame and are the same for other spinning machines each having a spindle motor control system such as a ring twister and a two-for-one twister.

To tie the snapped yarn, first the spindle motor 12 must be stopped. The spindle motor 12 is stopped by actuating the corresponding switch 11*s* to separately function the control circuit of the control circuit substrate 23. The control circuit substrate 23 must be provided for each spindle motor 12. There are some big spinning frame each having substantially 1000 spindle motors. In this case, substantially 1000 control circuit substrates are necessary. However, it is impossible that all of 1000 yarns snap at the same time so that there may be no situation that the all of the control circuit substrates are needed at the same time. It is quite poor economy to always prepare many control circuit substrates, though nobody knows when they will be actually needed, in view points of manufacturing expenses and maintenance/checkout expenses. To solve the aforementioned economical problem is the first object to be solved by the present invention.

Some of big spinning frames are 40 meters in overall length. Such a ring spinning frame is provided with about 1000 spindles. In such a spinning frame, power is supplied to at control unit 13 of an adjacent mechanical block by an inverter power source 26 through a power connecting line 31. The same is true for low voltage power supply, that is, low voltage power or signal is transmitted to control circuit substrates 23 of the control unit 13 through low voltage signal lines/low voltage power supplying lines 29 at a long distance e.g. tens meters. Since using the low voltage signal lines/low voltage power supplying lines renders undesired signal to be easily caught, the operation of circuit quite may become unstable and the control of the whole ring spinning frame may be seriously effected. To eliminate the serious effects is the second object to be solved by the present invention.

The final object to be solved by the present invention is to increase the efficiency of the power supply, i.e. to inhibit the voltage drop due to electrical resistance of the power supply line 27 and to increase the efficiency of the wiring. That is, a housing duct 67 has the power supply line 27 surfaced by a coating and the like incorporated therein. To minimize the electrical resistance, the power supply line 27 should be as thicker as possible (the cross section should be as greater as possible.). However, there is a limit to make the power supply line 27 thicker because of the size of the housing duct 67. Since it is necessary for the wiring to strip the coating from the power supply line 27, it is not necessarily effective. To solve this problem is the third object.

DISCLOSURE OF THE INVENTION

The inventor who has studied hard to solve the aforementioned first object dismissed the idea that al spindle motors in a conventional spinning machine should be provided with respective control circuit substrates and gave an attention to that a control circuit substrate positioned at a necessary place when necessary is sufficient. Further, the inventor has developed an alternative method for sending a low voltage power or signal to solve the second object. Furthermore, the inventor has devised in the configuration and the structure to increase the efficiency of the wiring, using a bare wire not a coated wire, in order to solve the third object. The present invention has been made from the aforementioned point of view. The detailed description will be made in other paragraphs below.

That is, a spinning machine according to a first embodiment of the invention includes: a plurality of spindles for drawing long and narrow fibers from a lump of natural fiber or synthetic fiber and twisting the drawn fibers; a plurality of spindle motors each provided for each spindle, an inverter power source for supplying power to the spindle motors, and three phase power supply lines for individually connecting the spindle motors and the inverter power source, and further comprises other member or device as needed. The spinning machine is character in that each three-phase power supply line is provided with switching mechanisms, for shutting down power, disposed on the ways of at least two phases of the three-phase power supply line, and braking devices each of which brakes each spindle when each switching mechanism is opened.

The spinning machine having the above futures does not have individual control circuits which a conventional spinning machine is provided with. Instead of this, power can be shut down by opening each switching mechanism disposed on the way of each three-phase power supply line and power can be supplied again by closing the switching mechanism. Since even after the power is shut down, the spindle motor does not stop soon because of the inertia, the spindle motor is braked or stopped directly or indirectly by the function of the braking device (brake). After the spindle motor stops (decelerates moderately), the snapped yarn may be tied. Because of the operation of the braking device, the snapped yarn can be repaired soon, thereby increasing the efficiency. After the yarn is repaired, the spindle motor is restarted by closing the switching mechanism to supply power. According to this structure, the spinning machine can be made at significantly low cost as compared to conventional one, thereby considerably improving the machine because of economic consideration (the first object is solved). Further, this structure can omit a long low voltage signal line/low voltage power supplying line and thus to avoid adverse effects caused by undesired signal which is indirectly caught by the long low voltage signal line/low voltage power supplying line, thereby stabilizing the operation of the low voltage circuits and thus stabilizing the control of the spinning machine (the second object is solved).

As for the "spinning machine" described in this specification, any one having the aforementioned features will do. Such a machine includes a two-for-one twister as well as a ring spinning frame and ring twisting frame. In addition, the "switching mechanisms" may be mechanical or electrical one or other one which has efficient functions for supplying and shutting down the power. The phrase "at least two phases of the three-phase power supply line" means either two or three phases will do.

It should be noted that the word "brake" means to restrain the rotation of the spindle (spindle motor) to decelerate or stop the spindle and the "braking device" may be any one having such a braking function. Examples of braking device are an electrical braking device which brakes the spindle by applying DC voltage to the spindle motor and a mechanical braking device which decelerates and stops the spindle by absorbing kinetic energy for rotating the spindle (spindle motor) by friction. Examples of the mechanical braking device are a manual brake, a vacuum brake, and an air brake which directly or indirectly provide mechanical fiction to the rotating spindle or the like.

A spinning machine according to the invention includes the same structures and effects as stated in claim 1 and is particularly character by the switching mechanism. That is, each switching mechanism includes a pair of conductive contacts which are in electrical contact with each other and an insulating unit which is allowed to be inserted or pulled out between the pair of conductive contacts, wherein the pair of conductive contacts are separated from each other when the insulating unit is inserted therebetween, and come in contact with each other again after the insulating unit is pulled out.

According to the switching mechanism, only the conductive contacts are separate members and the insulating unit can be used as a common member, thereby simplifying the structure of the switching mechanism and decreasing the cost. As for the "pair of conductive contacts", any one which can be in electrical contact with each other will do, regardless of material and configuration. In addition, the term "electrical contact" means being in contact to directly or indirectly flow current therebetween. As for the "insulating unit", any one which can separate the pair of conductive contacts when inserted therebetween and can allow the pair of conductive contacts to come in contact with each other after pulled out will do. Such an insulating unit includes one having insulation performance of itself such as synthetic resin plate and one having conductive performance but having any structure for shutting down current.

A spinning machine having a spindle motor control system according to the invention wherein has the foregoing wherein switching mechanisms wherein, each switching mechanism includes a pair of conductive contacts and a switching member slidably disposed between the pair of conductive contacts, wherein said switching member is provided with an insulating portion and a conductive portion which are selectively brought into contact with said pair of conductive contacts by sliding the switching member.

According to the switching mechanism, only by sliding the switching mechanism i.e. moving the switching member without pulling out, the conductive contacts in contact with the insulating portion (not conducted) can be brought in contact with the conductive portion to conduct electricity between the conductive contacts and vice versa. Though the switching member may be configured not to be pulled out between the conductive contacts, it is preferable that it is configured to be pulled out. If the switching member is configured to be pulled out, the switching member can be used as a common member, thereby simplifying the structure of the switching mechanism and decreasing the cost. In this case, it is preferable that the pair of conductive contacts are in electrical contact with each other when the switching member is pulled out.

A spinning machine according to the invention has switching mechanisms wherein. That is, each switching mechanism includes a pair of conductive contacts spaced from each other and a connecting member for electrically connecting the pair of conductive contacts when closed.

The conductive contacts and the connecting member may be formed in any configurations which sufficiently function for the purposes. The connecting member may be detachable or not.

A spinning machine according to the invention also may have a mechanical braking device. Wherein the braking device is character by including a fraction piece to be brought in contact with the spindle, a brake arm to which said fraction piece is fixed, an operational lever for bringing the brake arm close to or apart from the spindle, a supporting member for pivotably supporting the operational lever, and biasing means for biasing the brake arm in such a direction as to move apart from the spindle.

The mechanical braking device may be of a type that is mounted to each spindle or of a removable type that is mounted to any one of spindles as needed. Though at least one function piece and one brake arm are enough, it is preferable to push the spindle in the opposite directions at the same time (toward the axis of the spindle). The reason is that since the gap between the stator and the rotor of the spindle motor is quite small, the spindle swings so that the stator and the rotor come in contact with each other when the friction piece is pushed to the spindle in one direction. If possible in view of cost and structure, three friction pieces may be disposed 120° apart from each other and structured to push the spindle at the same time (toward the axis of the spindle). The operational direction of the operational lever may be the vertical direction, the horizontal direction, or other direction.

A spinning machine having a spindle motor control system with a braking device may be characterized by including a brake voltage supplying device for applying braking DC voltage to the spindle motor.

It should be understood that this electrical braking device supplies the braking voltage sufficient to brake the spindle and may be individually mounted to each spindle, like the mechanical braking devices, or may be detachable so that the electrical braking device can be attached to any spindle as needed. It should be understood that the braking voltage is sufficient to brake the spindle.

A spinning machine according to the invention may be particularly characterized by DC voltage applied by a braking voltage supplying device. That is, the DC voltage is characterized in that it is produced by rectifying three phases or any two phases of the three-phase power supply line, i.e. by rectifying AC voltage obtained from the inverter power source as the driving power supply of the spindle motors.

The DC voltage is obtained in this manner so that another power source for the braking voltage is no longer necessary, thereby reducing the entire cost of manufacturing the spinning machine.

A spinning machine according to the invention may also be characterized in that the opening and closing of the each switching mechanism corresponds to the braking and release of the braking device.

These are coupled to each other so that the braking device can be actuated by opening the switching mechanism and, conversely, the braking device can be released by closing the switching mechanism. One action renders a plurality of actions, thereby simplifying the operation and allowing another operation such as repairing of snapped yarn to be rapidly and efficiently done. Designers can determine which operation of the switching mechanism or the braking device is the main according to his/her idea and the structure of the switching mechanism (the braking device). How they are coupled (correspond) to each other may use any method considered by persons skilled in the art.

A spinning machine according to the invention may be particularly character the method of fitting the switching mechanism. That is, stator windings of each spindle motor are fixed by filing synthetic resin materials around the stator windings, and the synthetic resin materials are formed in such a manner that each switching mechanism is partially or entirely fitted to the synthetic resin.

Such a structure mentioned above can omit a motor casing which is usually used for protecting the stator windings, thereby saving troubles for assembling them and decreasing the cost. The reason of using the synthetic resin is that the synthetic resin allows the configuration to be designed with relatively wide flexibility to fit the configurations of the stator windings and the switching mechanism and can easily insulate the stator windings from the switching mechanism and other components. It should be noted that the phrase "the switching mechanism is partially or entirely fitted" includes a case where the switching mechanism has a single component and a case where the switching mechanism has a plurality of components. In the latter case, the part or the entire of the switching mechanism means (a portion or the entire of) one or some of the components or (a portion or the entire of) all of the components. Any fitting method can be employed.

A spinning machine according to another embodiment the invention includes: a plurality of spindles for drawing long and narrow fibers from a lump of natural fiber or synthetic fiber and twisting the drawn fibers; a plurality of spindle motors each provided for each spindle, an inverter power source for supplying power to said spindle motors, and the phase power supply lines for individually connecting said spindle motors and said inverter power source, wherein each three-phase power supply line is provided with a pair of conductive contacts electrically connected to at least two phases on the way thereof, the pair of conductive contacts are structured to allow a circuit unit to be inserted and pulled out there between.

The spinning machine as structured above exhibits basically the same effects as previously stated for a first embodiment because it does not have individual control circuits which are provided in a conventional spinning machine. The main differences in structure between this spinning machine and that previously stated for the first embodiment are that this spinning machine uses the pair of conductive contact and the circuit unit as the switching mechanism and that the circuit unit has the functions of the braking device.

The circuit unit has a DC braking mode and at least one of three modes: a three-phase power shutdown mode, three-phase power supplying mode, and a Reduced DC braking mode set therein, any one of the DC braking mode and the set models) can be selected by operating a control switch. That is, the circuit unit can select at least one of the three modes besides the DC braking mode as necessary. The circuit unit is inserted between the pair of conductive contacts to separate the pair of conductive contacts so as to be actuated, while the circuit unit is pulled out to bring the pair of conductive contacts into contact with again.

To select at least one of the three modes means to select one mode (for example, three-phase power shutdown mode) set in the circuit unit, or to select needed one of two (for example, three-phase power shutdown mode and the three-phase power supplying mode) or three modes set in the circuit unit. In the former case, only the three-phase power shutdown mode is set (selected) and thus either the DC braking mode or three-phase power shutdown mode is selected. On the other hand, in the latter case where the two modes are set, either the DC braking mode, three-phase power shutdown mode, or the three-phase power supplying mode is selected. The same is true for a case where another mode than the three modes is set.

Hereinafter, the details of the modes set in the circuit unit are as follows. When the DC braking mode is selected, the circuit unit stops the spindle motor by applying DC voltage, obtained from the braking voltage supplying device, to the spindle motor. When the three-phase power shutdown mode is selected, the circuit unit shuts down three-phase AC power to the spindle motor. When the three-phase power supplying mode is selected, the circuit unit supplies three-phase AC power to the spindle. Further, when the Reduced DC braking mode is selected, the circuit unit applies DC voltage, obtained from the braking voltage supplying device, to the spindle motor to prevent the stopped spindle from rotating involuntarily.

The aforementioned "circuit unit" may be formed to match with the configuration of the pair of conductive contacts or the like. The "braking voltage supplying device" may be any one which can supply DC voltage needed for stopping the spindle motor to the degree which allow the yarn to be repaired. In addition, the term "involuntary rotation" means the passive rotation of the spindle motor because of external force exerted on the spindle motor, not the active rotation of the spindle motor because of power supplied to the spindle motor. Since a snapped yarn is repaired by twisting (rotating) the yarns, the spindle motor involuntarily rotates due to the external force produced at this time. As the spindle motor involuntarily rotates, it is difficult to twist the yarn. To prevent the involuntary rotation, subdued DC voltage lower than the braking DC voltage is applied to the spindle motor. Since the circuit unit operates only when inserted between the conductive contacts, three-phase AC is applied to the spindle motor after pulling out the circuit unit.

A spinning machine having a spindle motor control system as seen in the present embodiment is particularly characterized by the braking voltage supplying device. That is, the braking voltage supplying device is characterized in that the braking voltage supplying device produces the DC voltage and subdued DC voltage by rectifying three phases or any two phases of each three-phase power supply line.

In the structure as mentioned above, the DC voltage can be obtained by a simple circuit, thereby improving the cost effectiveness. Also it allows the circuit unit to be miniaturized and light weight so that it is convenient when the circuit unit is carried in a spinning factory.

A spinning machine having a spindle motor control system according to the present embodiment is particularly characterized by a relay unit as described hereinafter. That is, the relay unit electrically relays the circuit unit and the pair of conductive contacts. The relay unit is structured, instead of the circuit unit, to be inserted and pulled out between the pair of conductive contacts. Moreover, the relay unit allows the circuit unit to be inserted and pulled out therebetween. In addition, the relay unit functions as an insulating unit for insulating the pair of conductive contacts when the relay unit is inserted alone.

The main feature of this spinning machine is that the contact between the circuit unit and the conductive contacts are carried out via the relay unit not by directly inserting (connecting) the circuit unit between the conductive contacts. When the circuit unit is pulled out the relay unit inserted between the conductive contacts or the relay unit is inserted between the conductive contact alone, the relay unit functions as an insulating unit so as to shut down the power to the spindle motor. The reason why relay unit is provided is that the relay unit is convenient in particular when the spindle motor is still desired to be stopped even after pulling out the circuit unit for some reasons. Since the conductive contacts are insulated even after pulling out the circuit unit, the spindle motor still stops. As the relay unit is inserted alone, the relay unit can be used as the insulating unit as stated in claim 2.

A spinning machine according to the present embodiment of the invention is particularly characterized by the method of fitting the pair of conductive contacts. That is, stator windings of each spindle motor are fixed by filing synthetic resin materials around the stator windings, and the synthetic resin materials are formed in such a manner that each switching mechanism is partially or entirely fitted to the synthetic resin.

As the method of fitting the pair of conductive contacts, any method which allows the conductive contacts to be fitted without losing the functions thereof may be employed. In addition, there is no limitation with reference to the direction in which the conductive contacts are fitted.

A spinning machine having a spindle motor control system according to a further embodiment of the invention includes: a plurality of spindles for drawing long and narrow fibers from a lump of natural fiber or synthetic fiber and twisting the drawn fibers; a plurality of spindle motors each provided for each spindle, an inverter power source for supplying power to the spindle motors, and three-phase power supply lines for individually connecting the spindle motors and the inverter power source, and is characterized by the three-phase power supply lines.

The features of the three-phase power supply lines are that each of them comprises bare three-phase buses, i.e. three-phase buses which is not covered, connected to the inverter power source and distributing lines connecting the three-phase buses and each spindle motor, and the three-phase buses are embedded in a casing made of insulating material and partly exposed from the casing. Therefore, the efficiency of the power supply can be increased and the efficiency of the wiring can be increased (the third object is solved). That is, for example, non-covered bare copper bars (copper poles) are embedded in a casing formed by molding synthetic resin as insulating material and are used as the three-phase buses. In this case, the synthetic resin inserted between the copper bars functions as covers (insulating member) so that the it is not necessary to cover the three-phase buses. The copper bars i.e. three-phase buses can be thicker (increased in sections) because of the covers which is no longer needed. The three-phase buses may be other conductive members instead of the copper bars. The exposed face of each copper bar may be formed in any configuration which allows the wiring.

A spinning machine having a spindle motor control system according to the present embodiment is characterized in that at least exposed part of each three-phase bus is formed in plane. Though there is no limitation for the configuration of the exposed face as mentioned above, it is preferable that the exposed face of each three-phase bus is formed in plane because the contact resistance can be reduced by increasing the cross sections of the three-phase bus and another conductive member (copper bar) to be connected to the three-phase bus. It is also preferable for mounting solderless terminals because the plane face facilitates the mounting.

A spinning machine having a spindle motor control system according to the present embodiment is characterized in that each three-phase bus exposed from the casing is provided with a detachable terminal for allowing each distributing line to be attached or detached to the three-phase bus. Such a detachable terminal allows the distributing line to be attached or detached, thereby increasing efficiency of the wiring. If necessary, other wire besides the distributing line may be connected. This "detachable terminal" may be of a screw type or a jack type. An example of such a type is a banana jack (banana plug) formed in a banana-like shape.

A spinning machine having a spindle motor control system according to yet another embodiment includes a plurality of spindles for drawing long and narrow fibers from a lump of natural fiber or synthetic fiber and twisting the drawn fibers; a plurality of spindle motors each provided for each spindle, an inverter power source for supplying power to the spindle motors, and three-phase power supply lines for individually connecting the spindle motors and the inverter power source, and is characterized in that each three-phase power supply line comprises bare three-phase buses connected to the inverter power source and distributing lines connecting the three-phase buses and each spindle motor. According to this structure, the bare three-phase buses are disposed in a casing at predetermined spaces, thereby increasing the sections of the bare three-phase buses because of no covering.

A spinning machine according to the present embodiment of the invention is characterized by insulating material filled among said bare three-phase buses. This structure increases the insulative property between the bare three-phase buses, thereby increasing the electrical safety of the spinning machine.

DESCRIPTION OF SPECIAL EMBODIMENT

Figure 1:
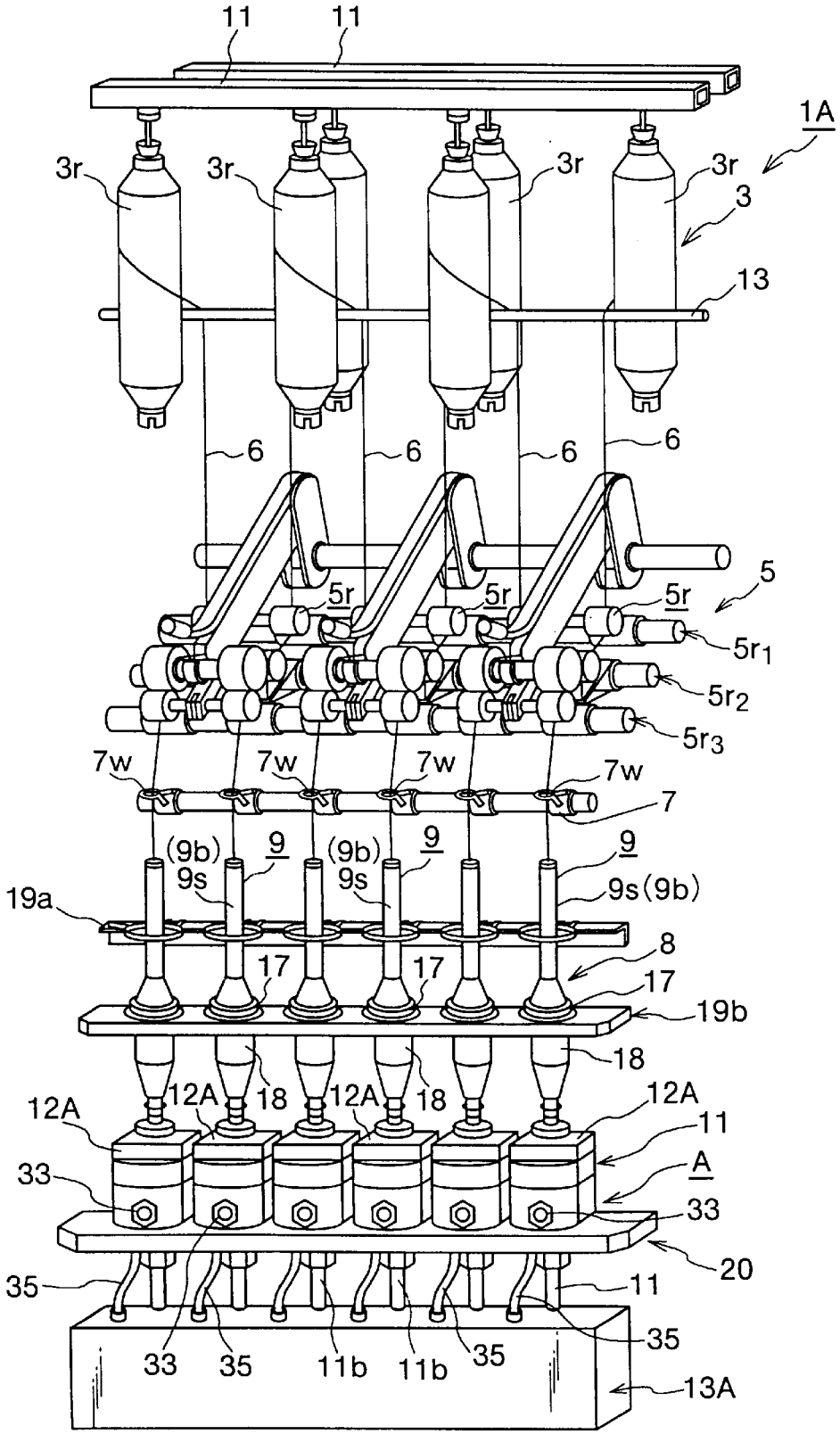
FIG. 1 is an entire perspective view of a ring spinning frame as the first embodiment.

Hereinafter, modes for carrying out the invention (in this specification, referred to as "Embodiments") will be described according to the mode for carrying out the invention with reference to the drawings. The differences between a spinning machine having a spindle motor control system of the present invention and the aforementioned prior art are related to the parts of the spindle motors and the control system thereof. Therefore, like parts are given by like reference numerals as used in the conventional spinning frame so as to omit the description about the parts.

Figure 2:
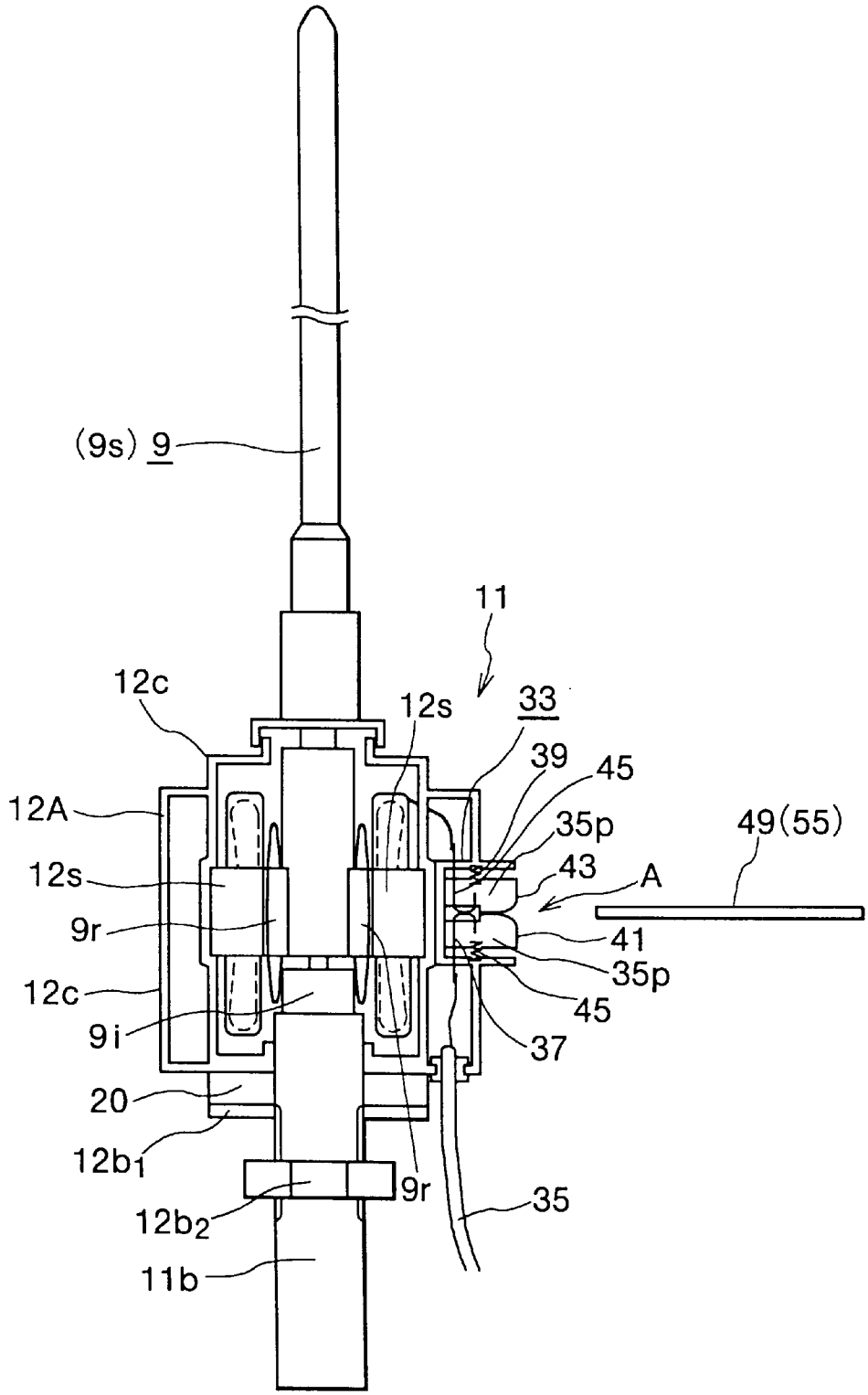
FIG. 2 is a vertical sectional view of a spindle and a spindle motor.
Figure 3:
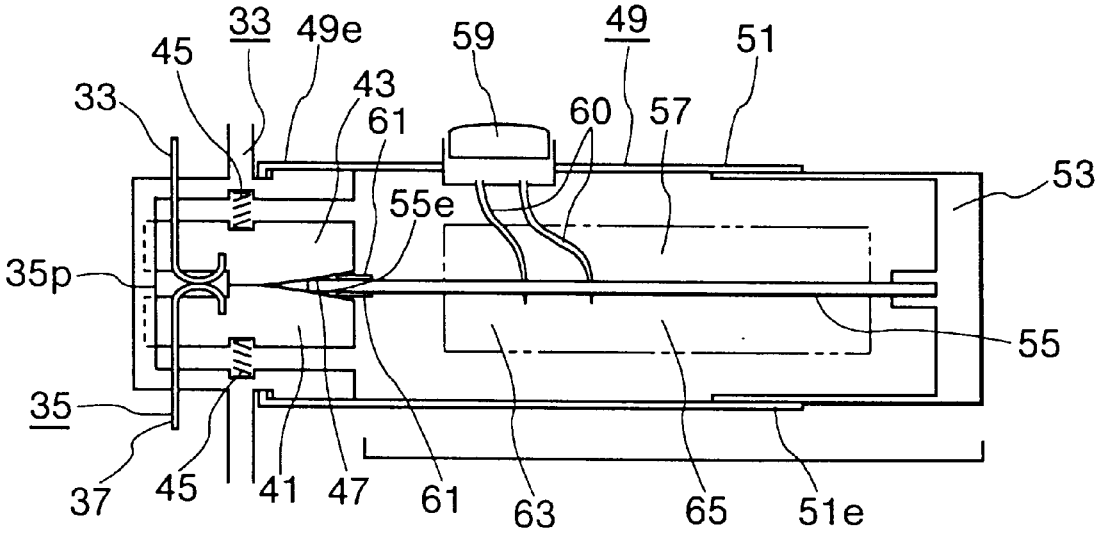
FIG. 3 is an enlarged view of the main parts shown in FIG. 2.
Figure 4:
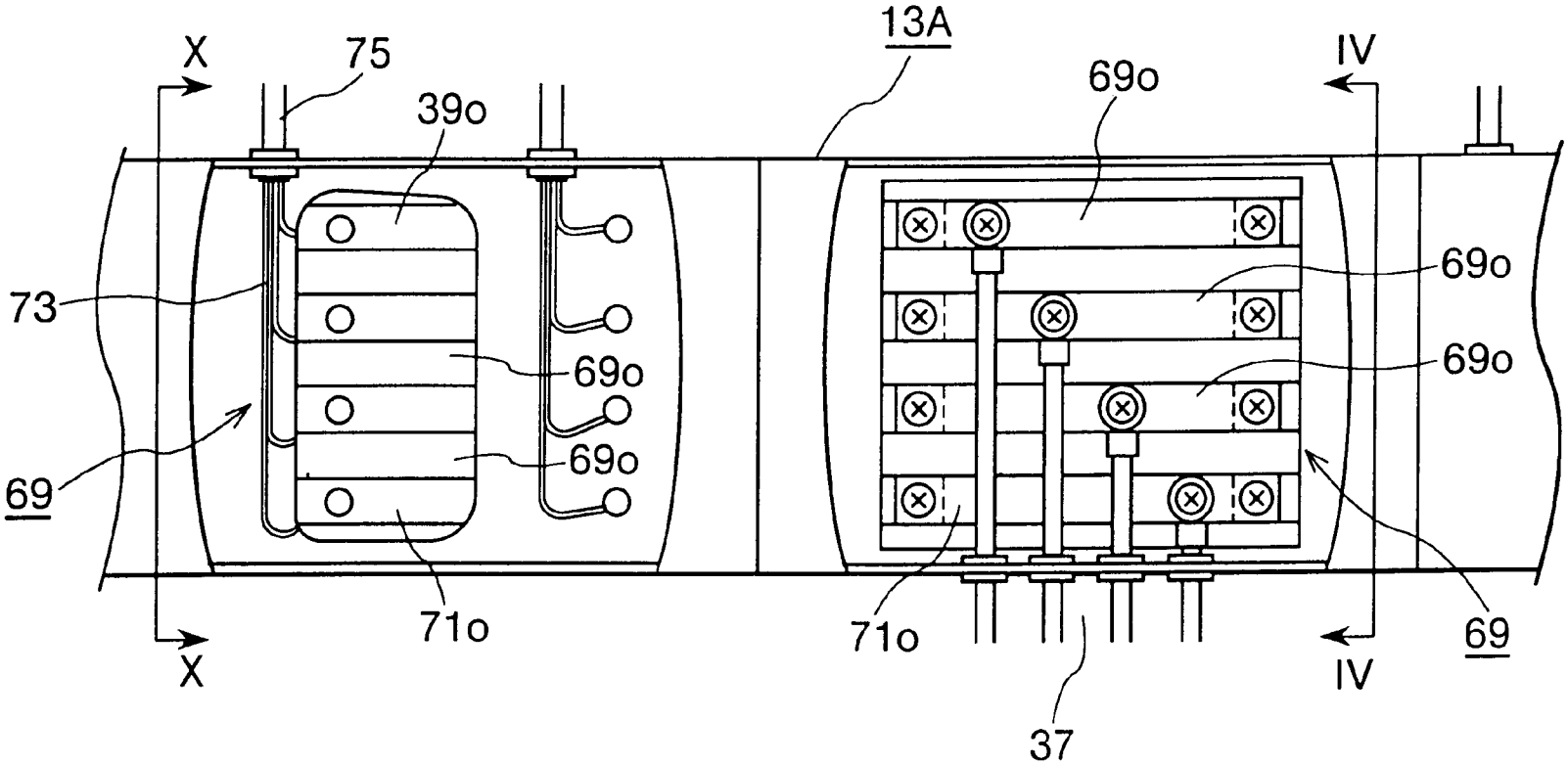
FIG. 4 is a partly enlarged view of a control unit.
Figure 5:
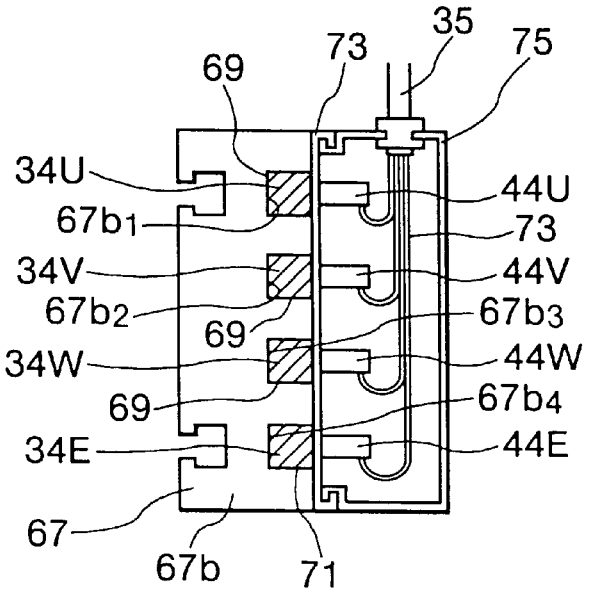
FIG. 5 is a view taken in the direction of arrows substantially along the line X—X of FIG. 4.
Figure 6:
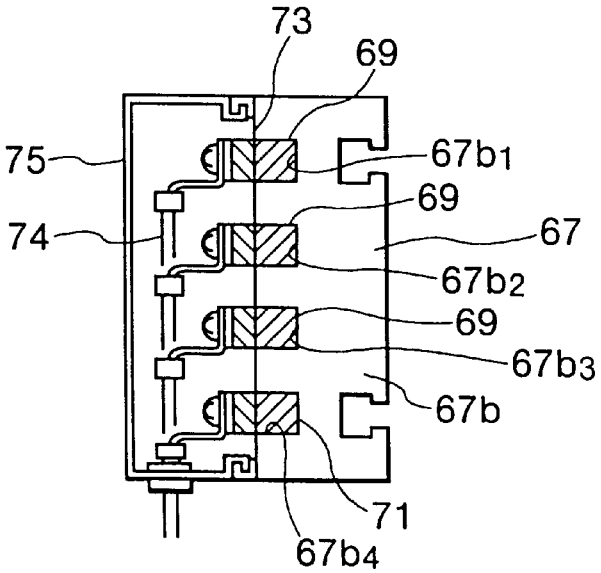
FIG. 6 is a view taken in the direction of arrow substantially along the line IV—IV of FIG. 4.
Figure 7:
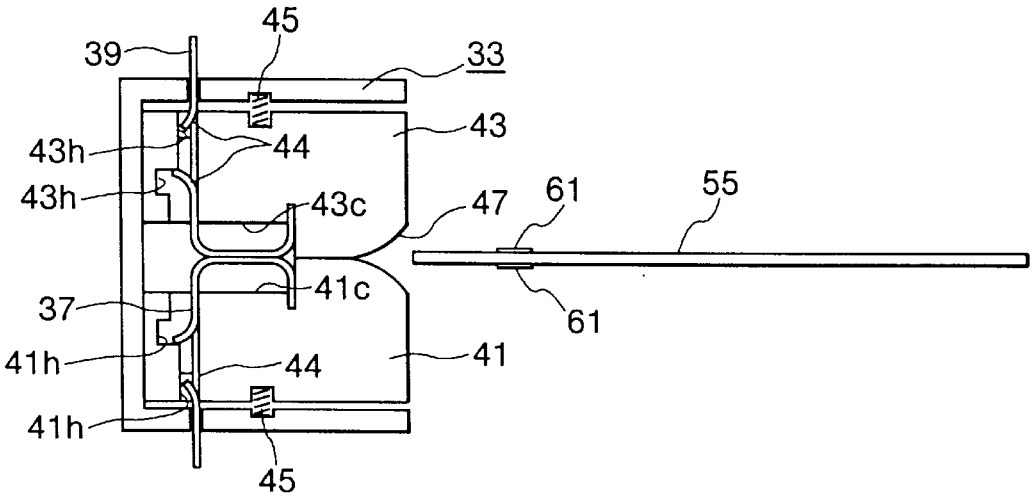
FIG. 7 is a view showing a state just before the circuit substrate is inserted between the contacts.
Figure 8:
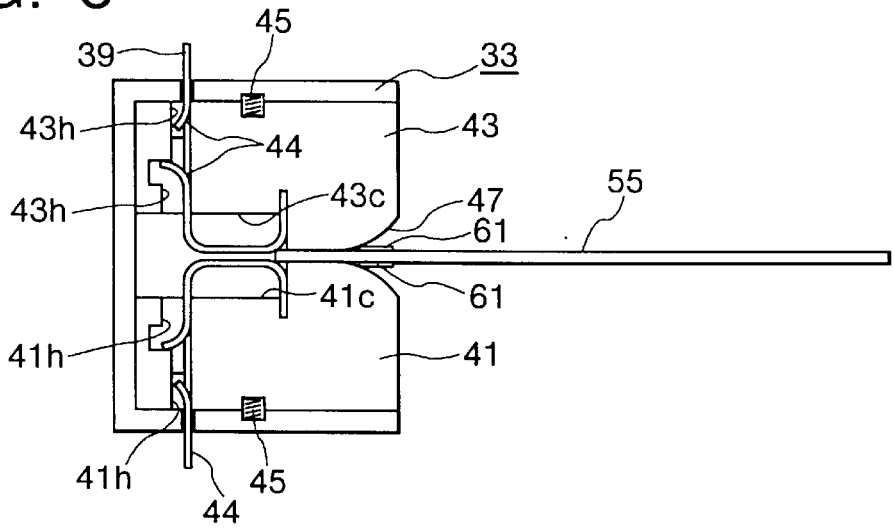
FIG. 8 is a view showing a state where the circuit substrate is just inserted therebetween.
Figure 9:
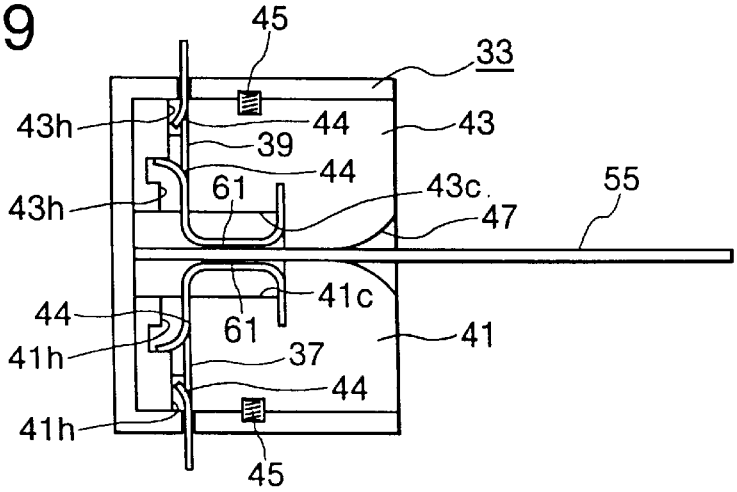
FIG. 9 is a view showing a state where the insertion is finished.
Figure 10:
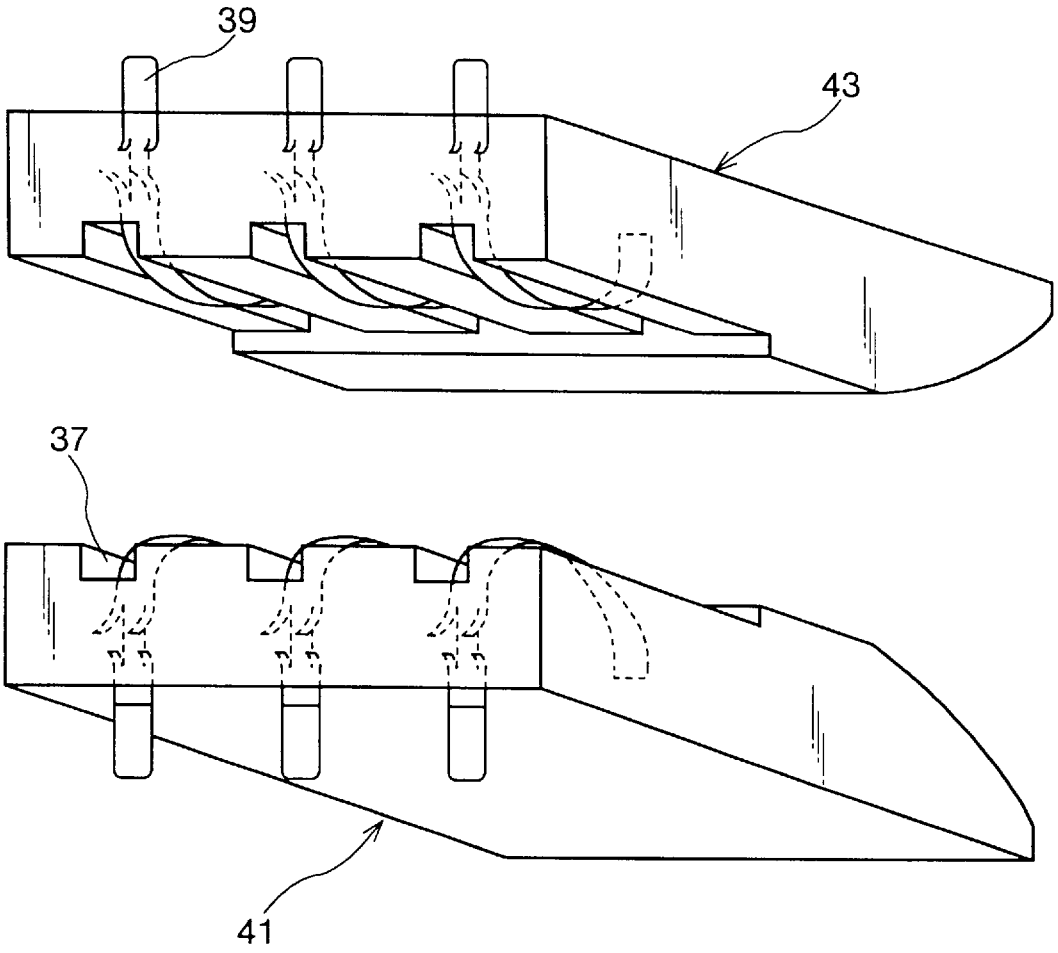
FIG. 10 is a view showing a state where conductive contacts are incorporated into supporting members.
Figure 11:
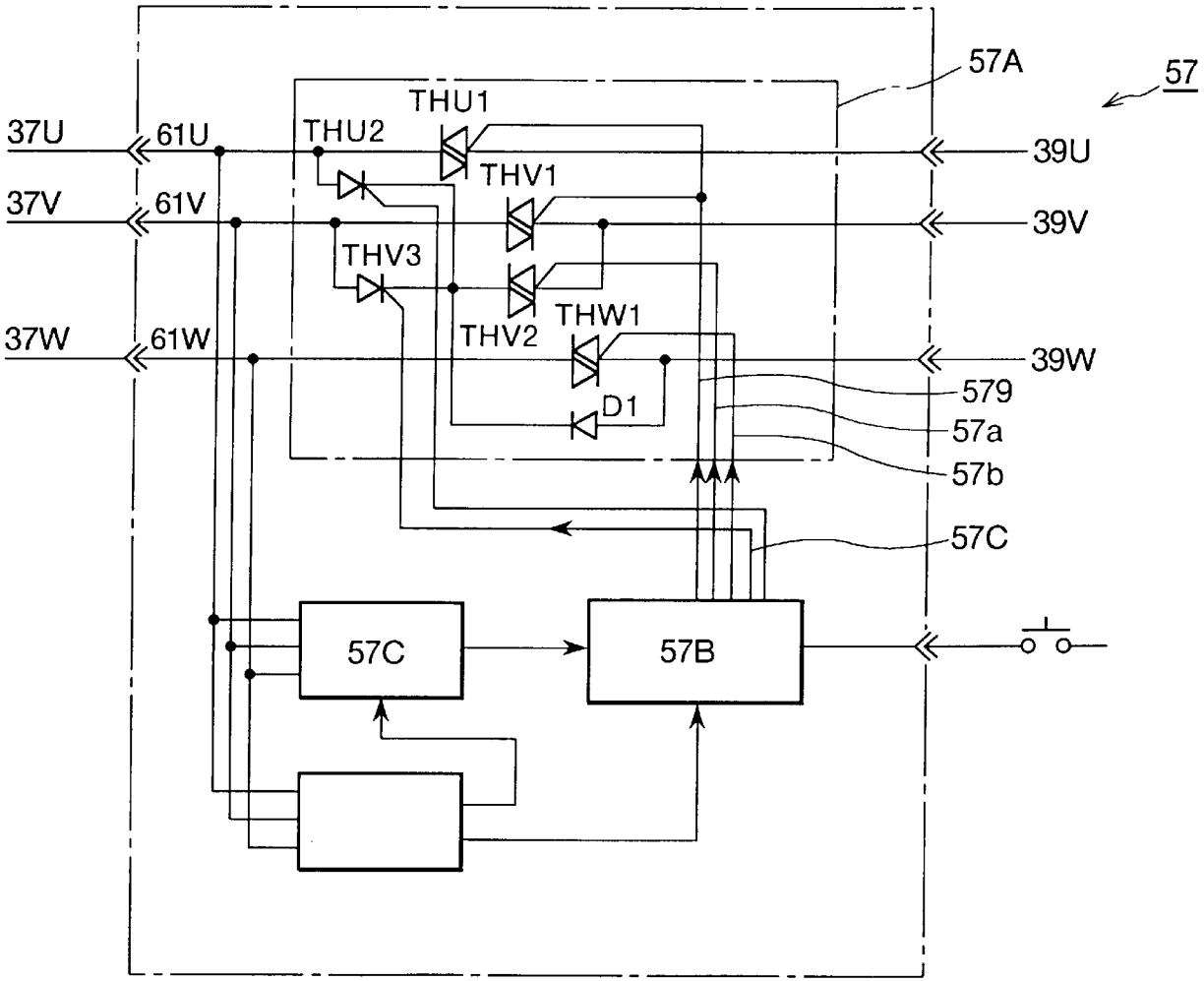
FIG. 11 is a circuit diagram for rectifying three phases of a three-phase power supplier.
Figure 13:
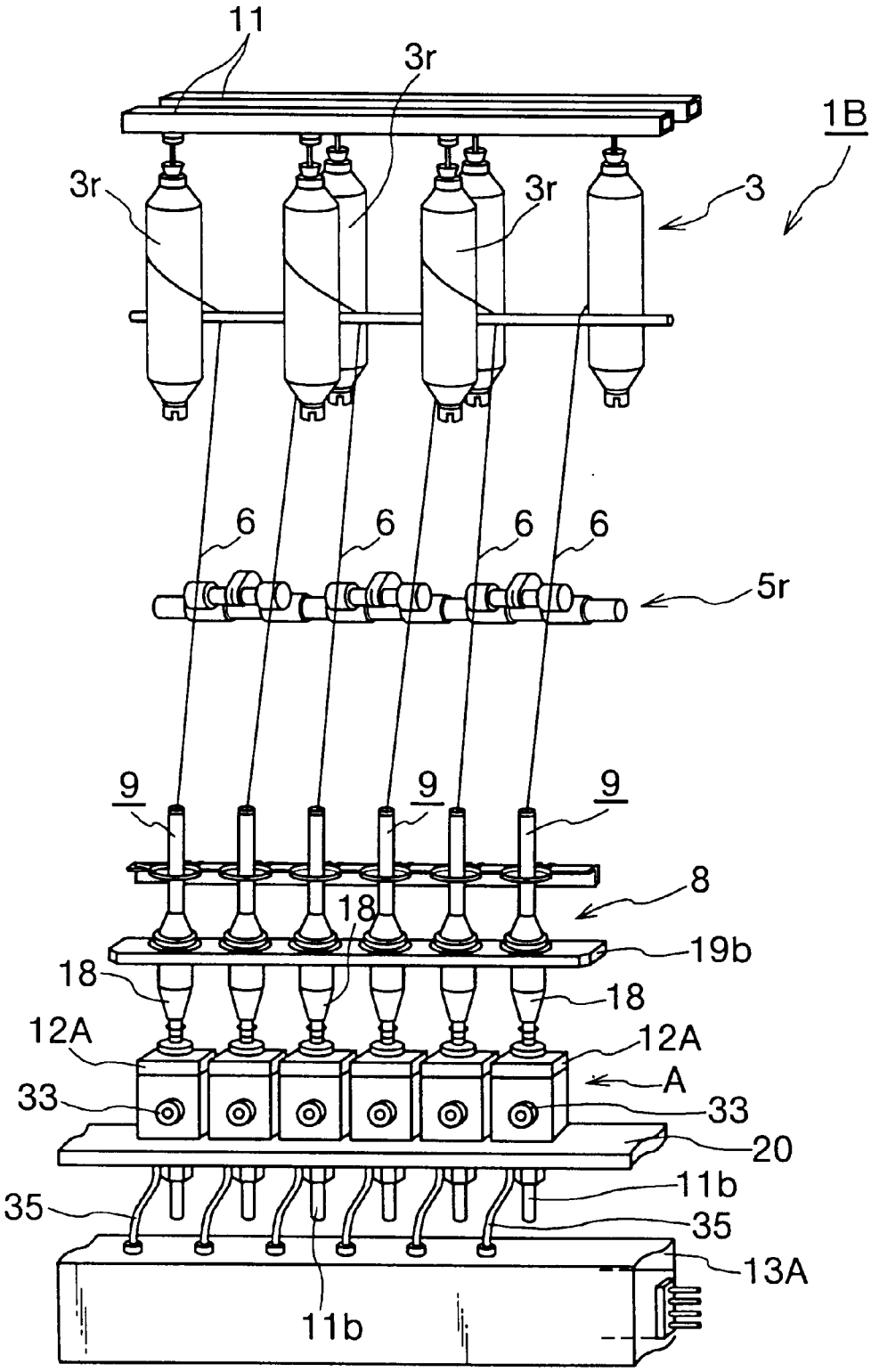
FIG. 13 is a schematic view showing the second embodiment.
Figure 14:
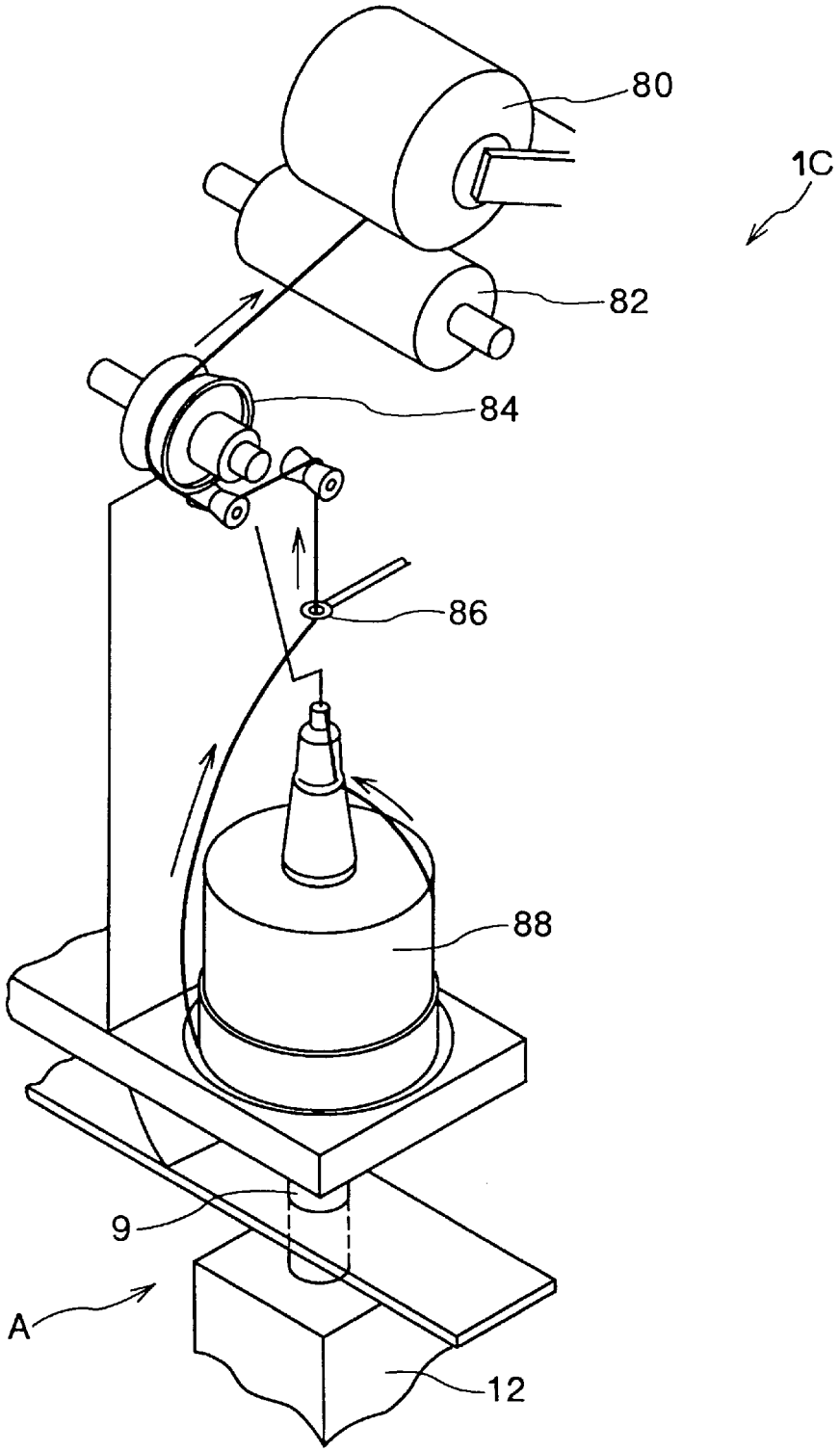
FIG. 14 is a schematic view showing the third embodiment.
Figure 16:
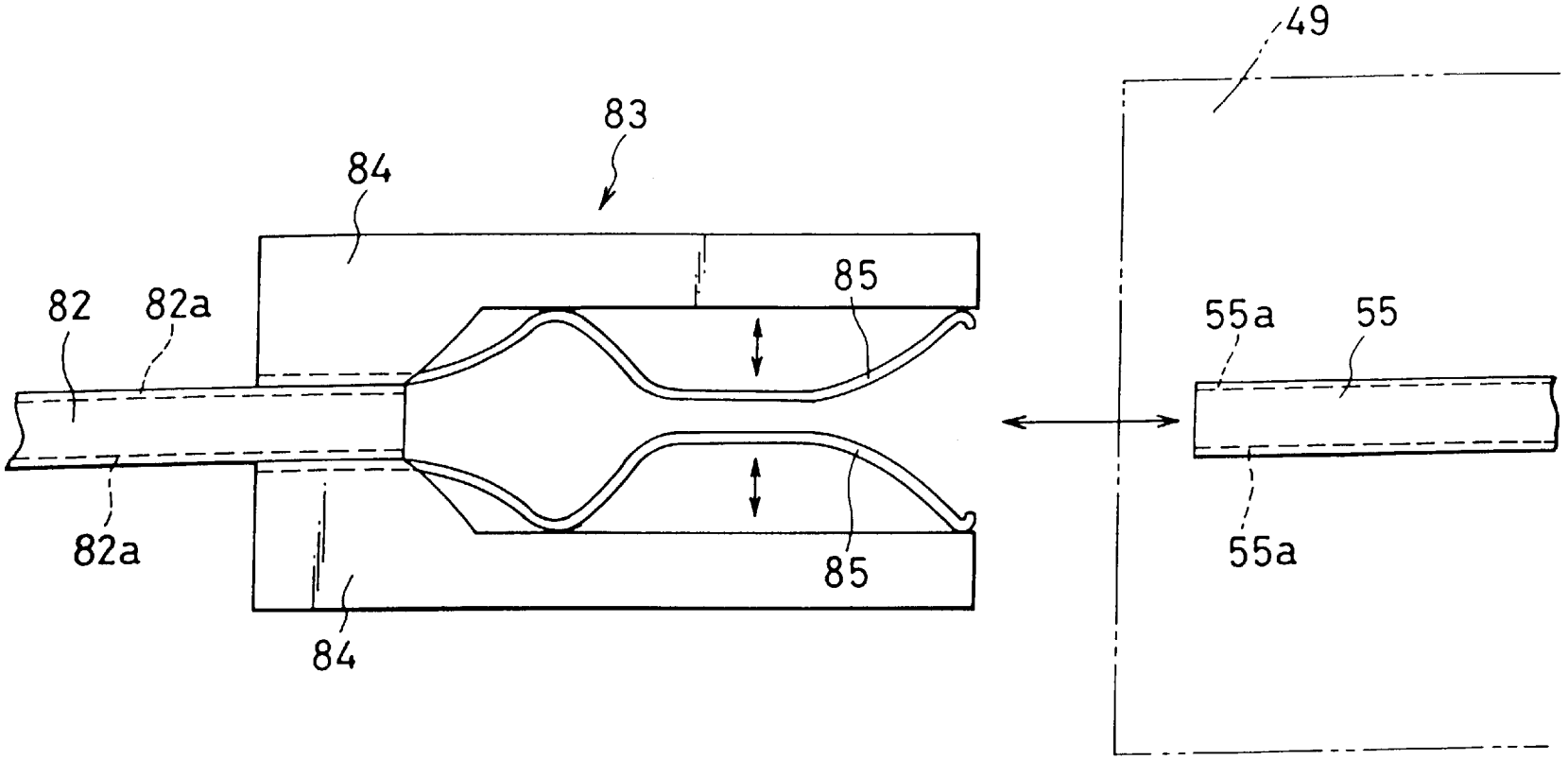
FIG. 16 is a partly enlarged view of a relay connector.
Figure 17:
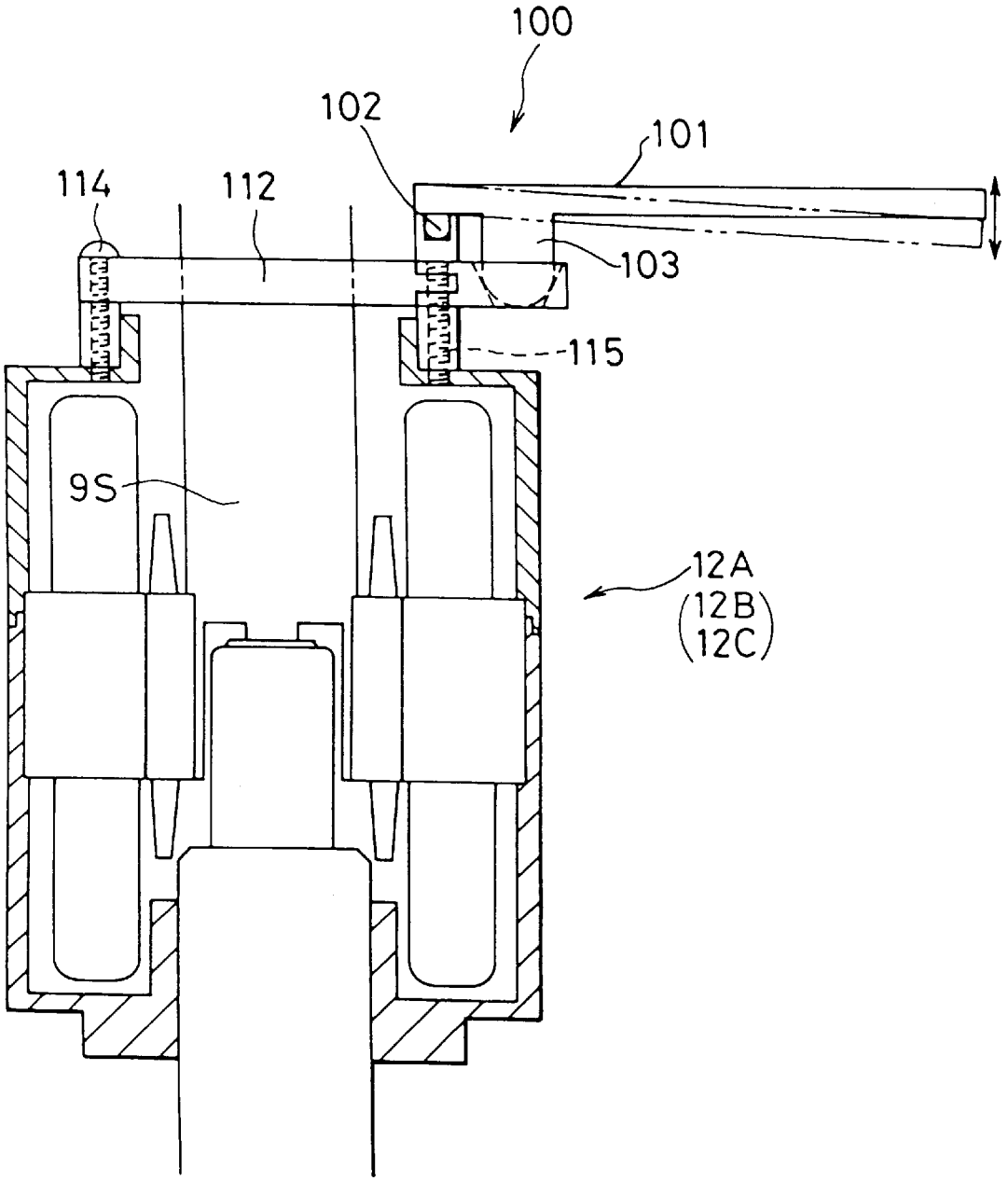
FIG. 17 is a schematic view showing the fifth embodiment.
Figure 18:
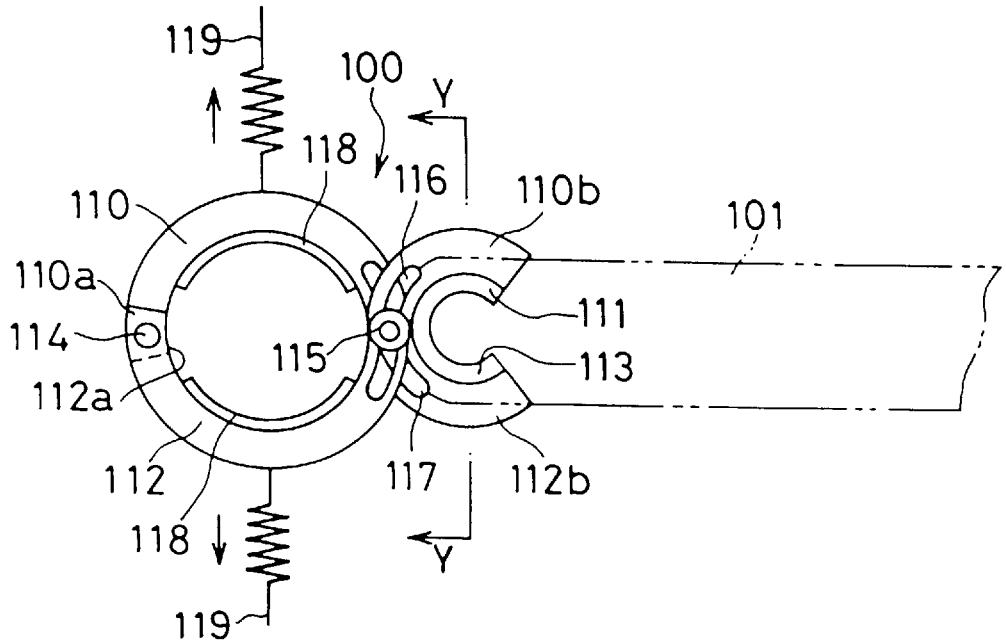
FIG. 18 is a front view of FIG. 17.
Figure 19:
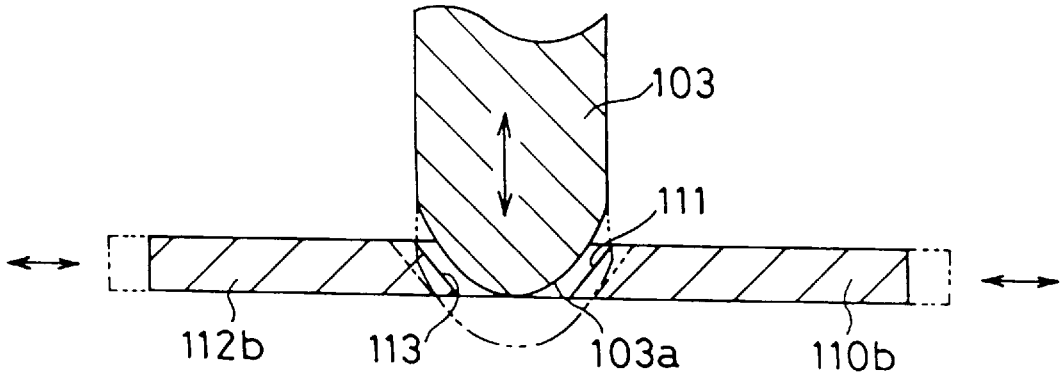
FIG. 19 is a view taken in the direction of arrow substantially along the line Y—Y of FIG. 18.
Figure 20:
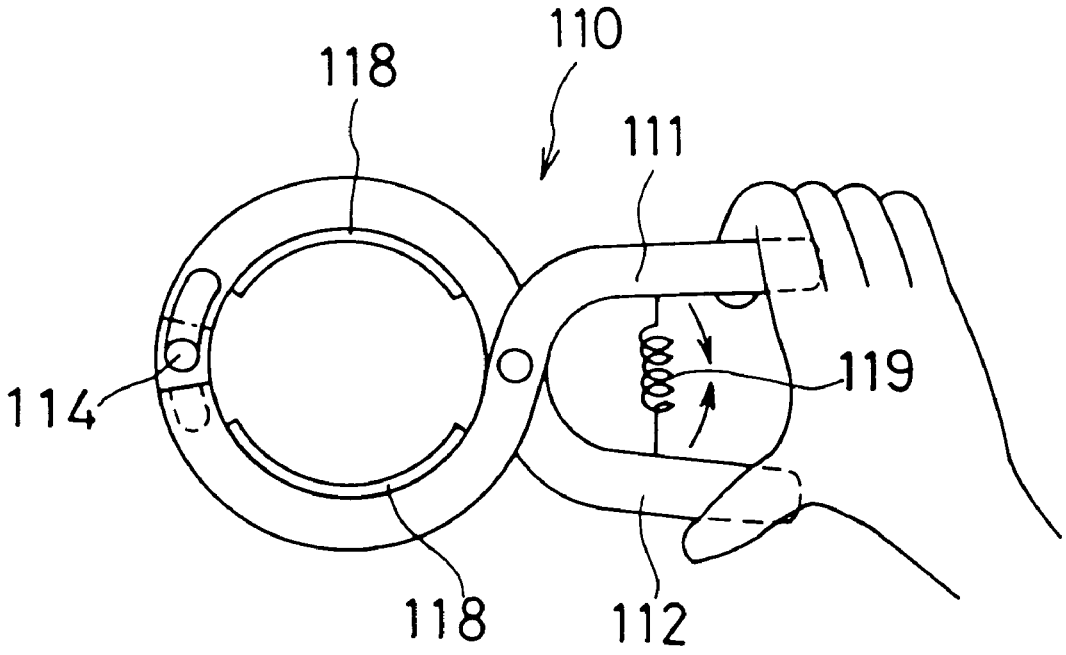
FIG. 20 is a schematic view of the sixth embodiment.
Figure 21:
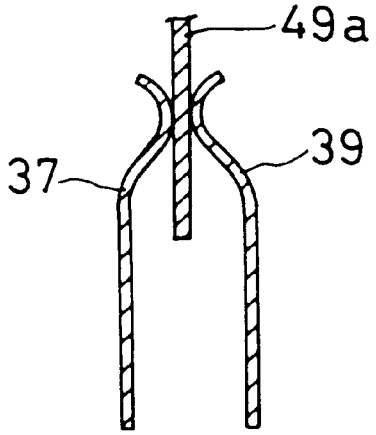
FIG. 21 is a plan view showing the schematic structure of a switching mechanism.
Figure 21:
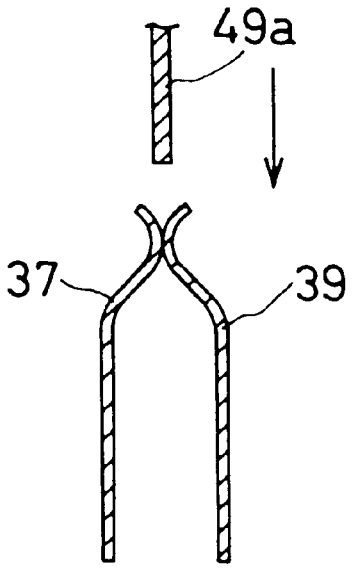
Figure 22:
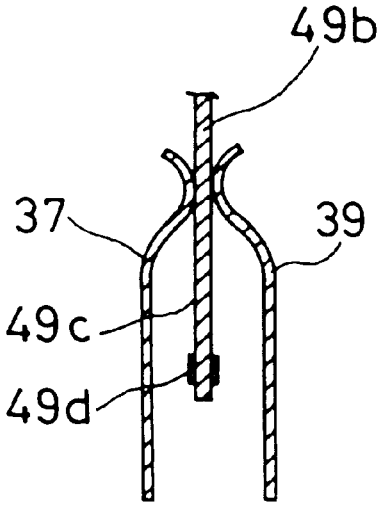
FIG. 22 is a plan view showing the schematic structure of a switching mechanism.
Figure 22:
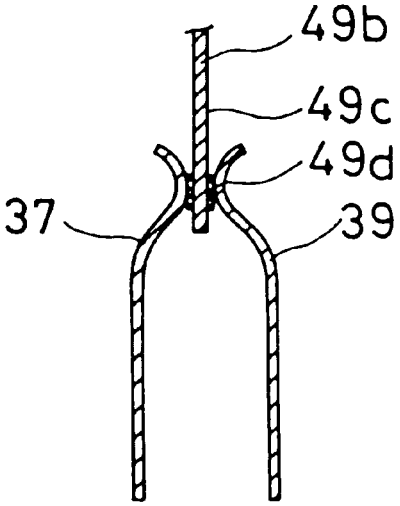
Figure 23:
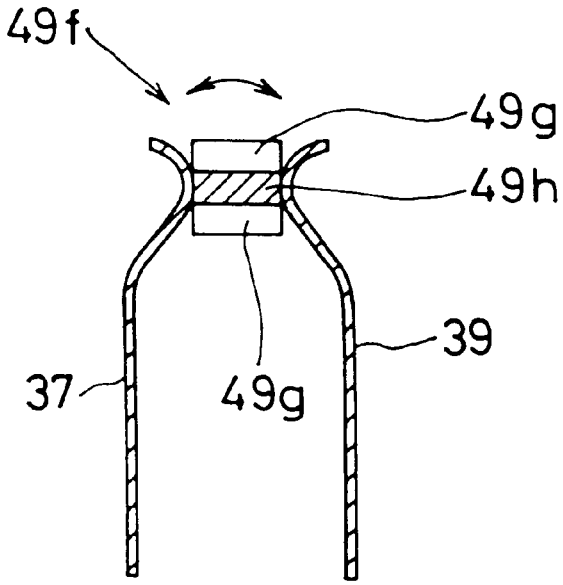
FIG. 23 is a plan view showing the schematic structure of a switching mechanism.
Figure 23:
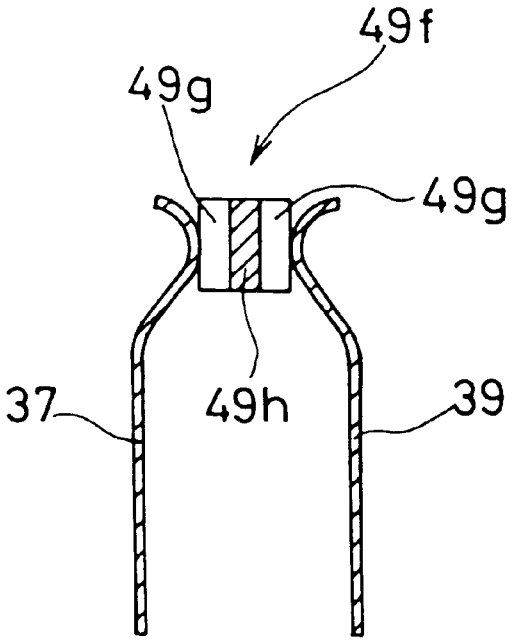
Figure 24:
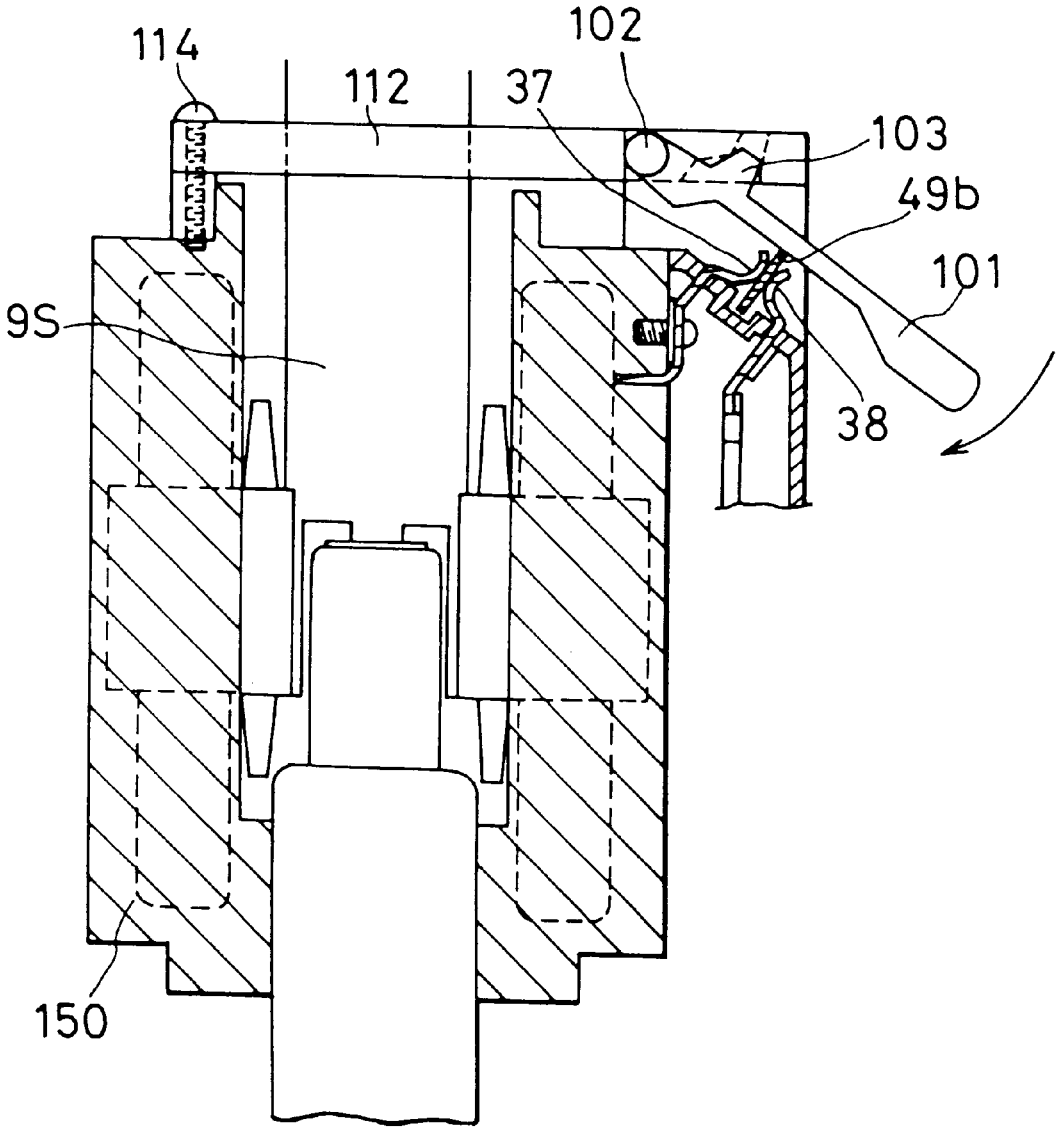
FIG. 24 is a schematic sectional view showing the seventh embodiment.
Figure 25:
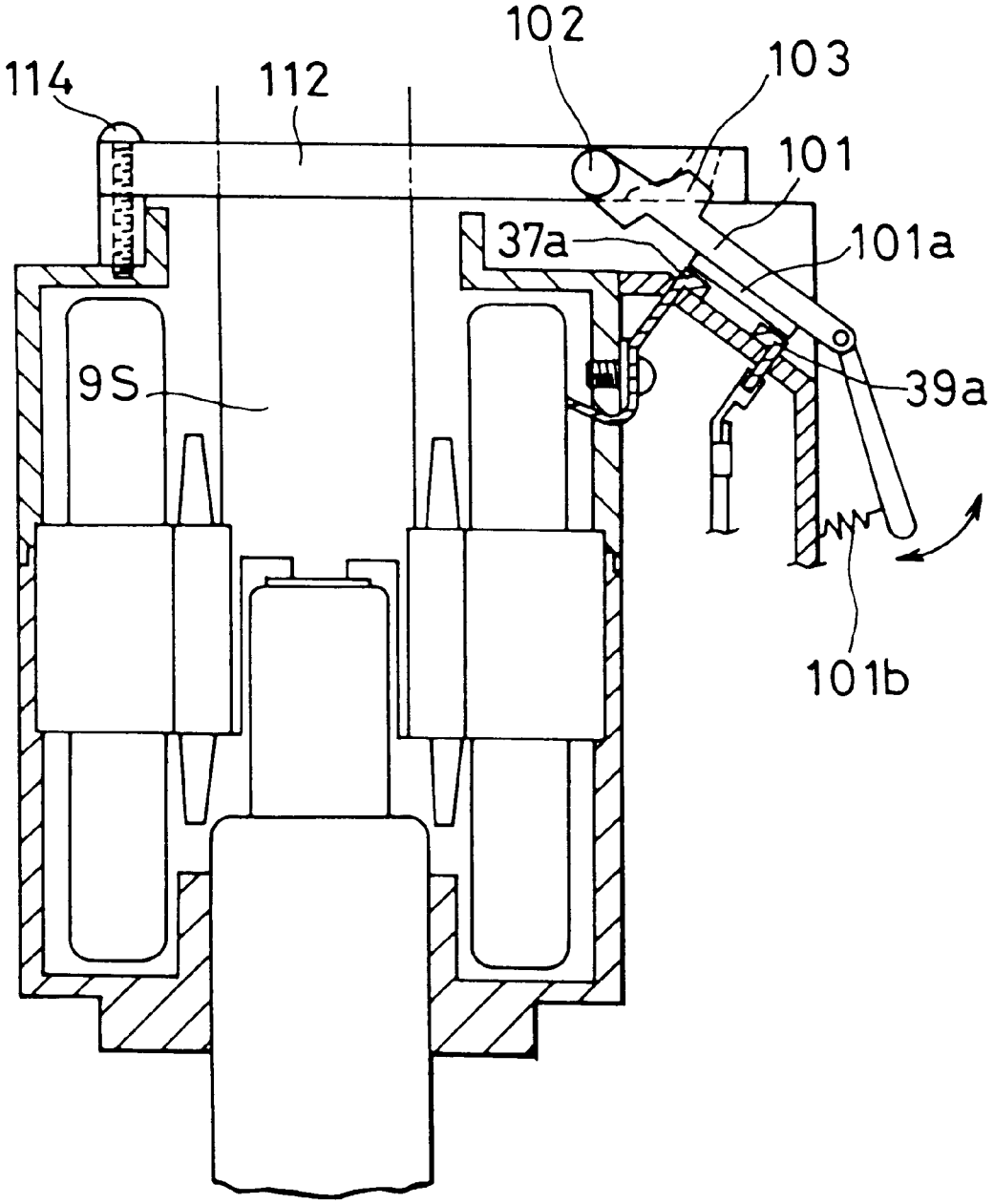
FIG. 25 is a schematic sectional view showing the seventh embodiment.

FIG. 1 is an entire perspective view of a ring spinning frame as the first embodiment. FIG. 2 is a vertical sectional view of a spindle and a spindle motor. FIG. 3 is an enlarged view of the main parts shown in FIG. 2. FIG. 4 is a partly enlarged view of a control unit. FIG. 5 is a view taken in the direction of arrows substantially along the line X—X of FIG. 4 and FIG. 6 is a view taken in the direction of arrow substantially along the line IV—IV. FIG. 7 is a view showing a state just before the circuit substrate is inserted between the contacts, FIG. 8 is a view showing a state where the circuit substrate is just inserted therebetween, and FIG. 9 is a view showing a state where the insertion is finished. FIG. 10 is a view showing a state where conductive contacts are incorporated into supporting members and FIG. 11 is a circuit diagram for rectifying three phases of a three-phase power supplier. FIG. 12 is circuit diagrams showing mode states, respectively and FIG. 13 is a schematic view showing the second embodiment. FIG. 14 is a schematic view showing the third embodiment and FIG. 15 is schematic views showing the fourth embodiment. FIG. 16 is a partly enlarged view of a relay connector and FIG. 17 is a schematic view showing the fifth embodiment. FIG. 18 is a front view of FIG. 17 and FIG. 19 is a view taken in the direction of arrow substantially along the line Y—Y of FIG. 18. FIG. 20 is a schematic view of the sixth embodiment. FIGS. 21 through 23 are plan views showing the schematic structure of a switching mechanism and FIGS. 24 and 25 are schematic sectional views showing the seventh embodiment.

Figure 26:
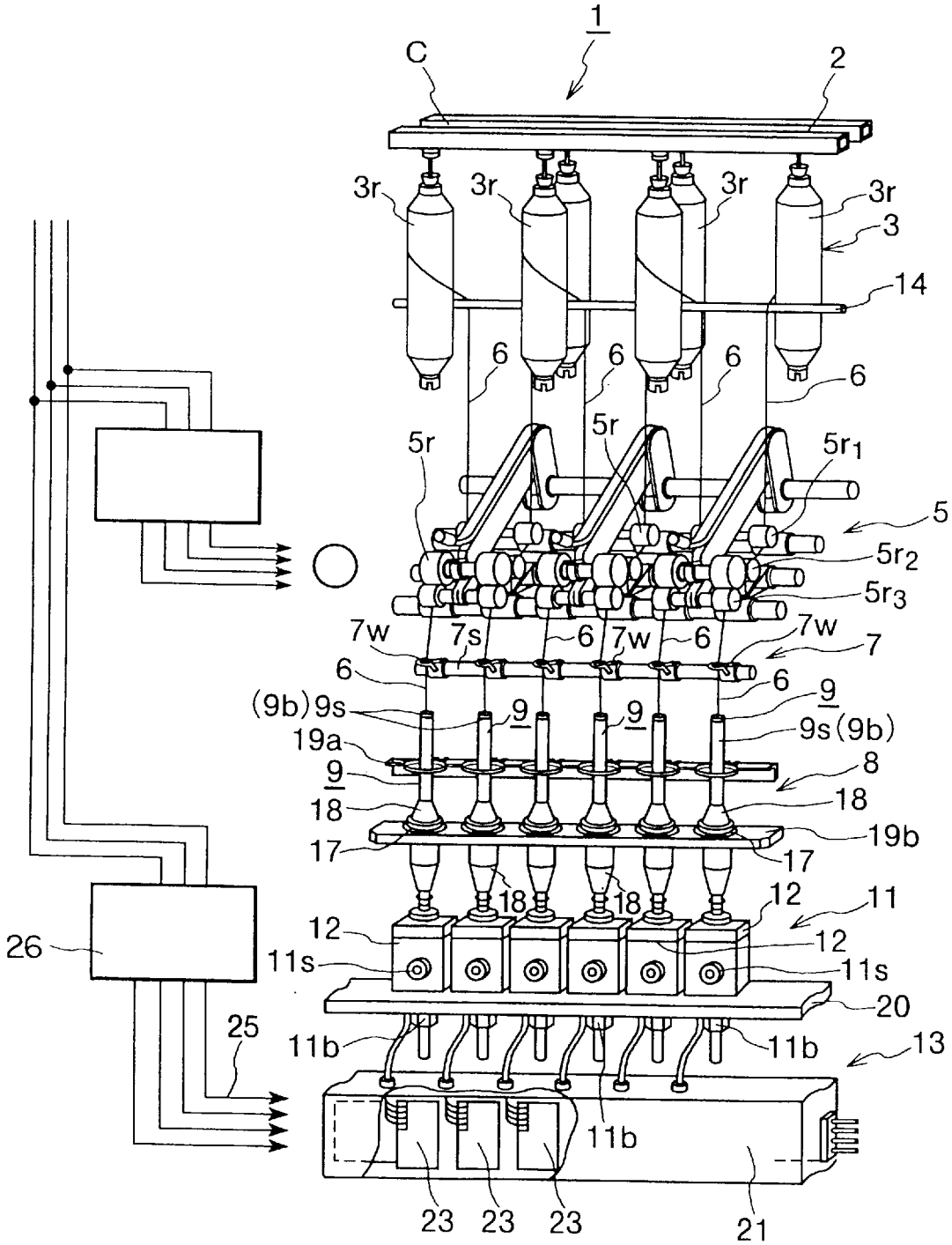
FIG. 26 PRIOR ART
FIG. 26 is an entire perspective view showing an example of conventional ring spinning frame.
Figure 27:
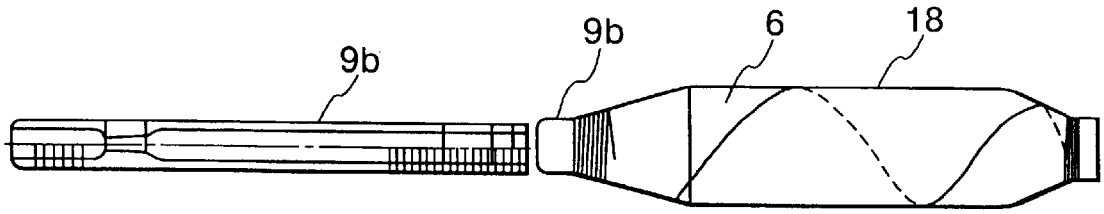
FIG. 27 PRIOR ART
FIG. 27 is a view showing a bobbin of a spindle unit and a full bobbin.
Figure 28:
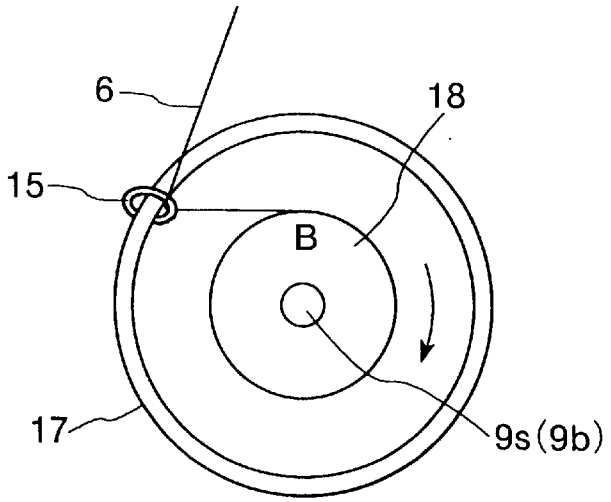
FIG. 28 PRIOR ART
FIG. 28 is a view of a spindle taken from the above.
Figure 29:
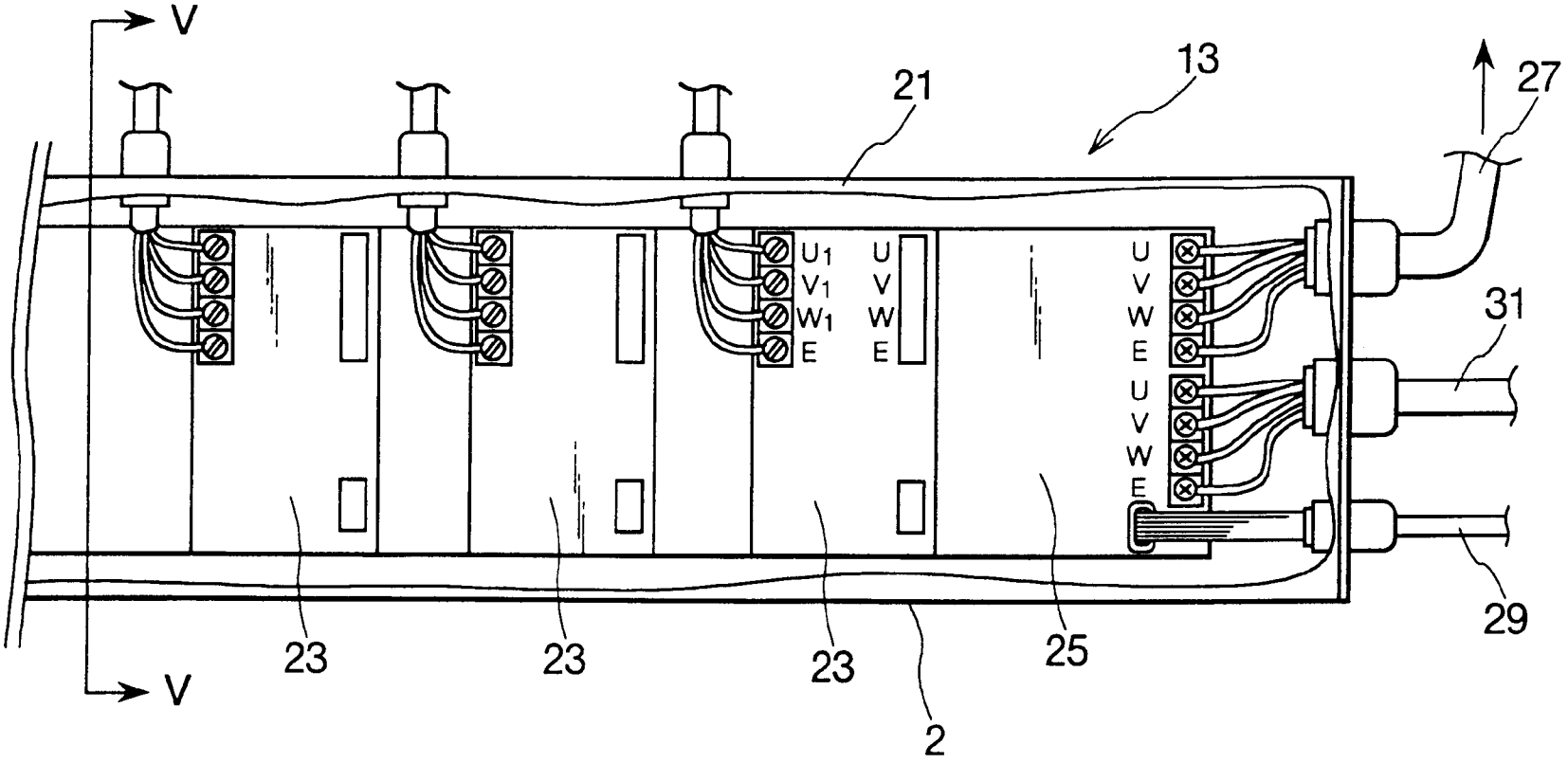
FIG. 29 PRIOR ART
FIG. 29 is an enlarged view of main components of a individual stop control unit 13.
Figure 30:
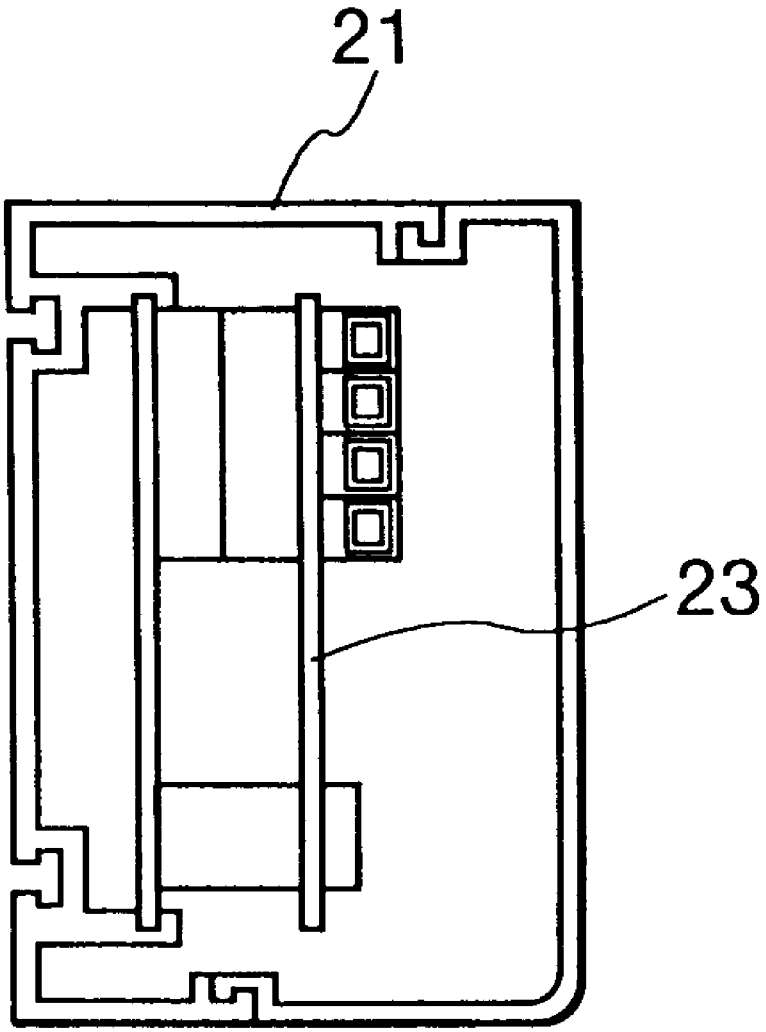
FIG. 30 PRIOR ART
FIG. 30 is a view taken in the direction of arrows substantially along the line V—V of FIG. 29.
Figure 31:
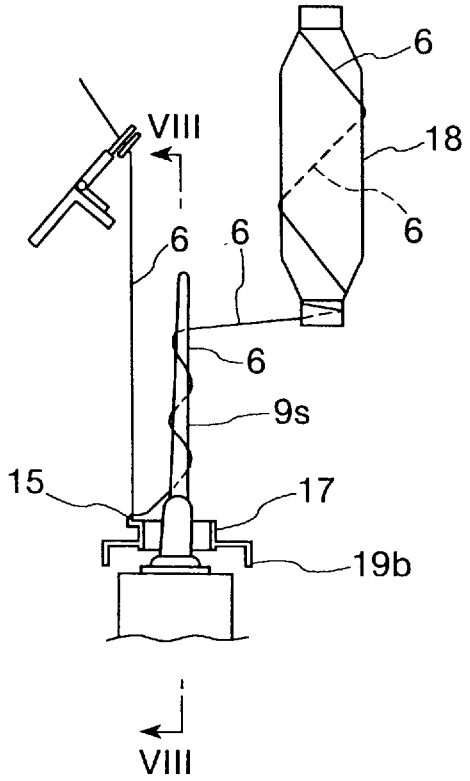
FIG. 31 PRIOR ART
FIG. 31 is a view showing a state where the fill bobbin is pulled out of the spindle blade.
Figure 32:
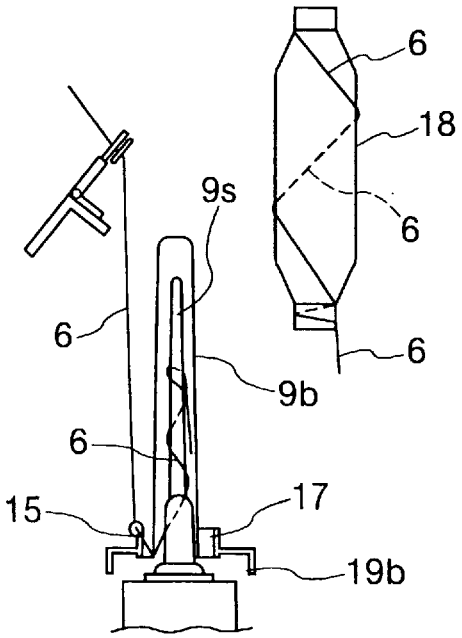
FIG. 32 PRIOR ART
FIG. 32 is a view showing the full bobbin 18 and the spindle blade covered by a bobbin.
Figure 33:
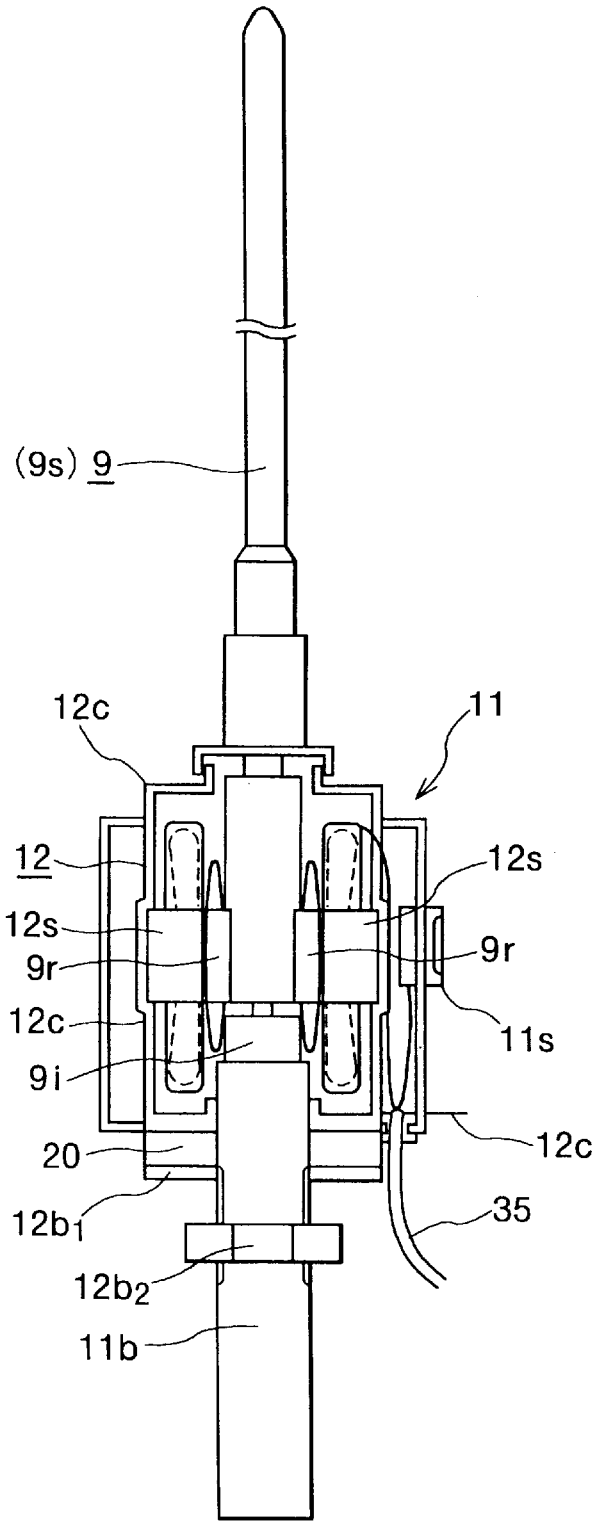
FIG. 33 PRIOR ART
FIG. 33 is a virtual sectional view taken in the direction of arrows substantially along the line VIII—VIII of FIG. 31.

FIG. 26 is an entire perspective view showing an example of conventional ring spinning frame and FIG. 27 is a view showing a bobbin of a spindle unit and a full bobbin. FIG. 28 is a view of a spindle taken from the above and FIG. 29 is an enlarged view of main components of a individual stop control unit. FIG. 30 is a view taken in the direction of arrows substantially along the line V—V of FIG. 29. FIG. 31 is a view showing a state where the full bobbin is pulled out of the spindle blade. FIG. 32 is a view showing the full bobbin covered by the bobbin to make another full bobbin and FIG. 33 is a virtual sectional view taken in the direction of arrows substantially along the line VIII—VIII of FIG. 31.

(First Embodiment)

In FIGS. 1 and 2, the reference numeral 12A designates each spindle motor. Each spindle motor 12A is in a hollow casing 12*c*. The hollow casing 12*c* is provided with an insertion portion 33 into which a circuit substrate unit (circuit unit) 49 can be inserted. As shown in FIGS. 2 and 3, a three-phase power supply line 35 for carrying power to the spindle motor 12A is inserted into each insertion portion 33. The three-phase power supply line 35 is cut at a relay 35*p* to which a pair of conductive contacts 37, 39 are connected. The conductive contact 37 and the other conductive contact 39 are brought into contact with each other to flow current. The conductive contact 37 is connected to the inverter power source 26 (FIG. 26) and the conductive contact 39 is connected to the spindle motor 12A. In this embodiment, the combination of the conductive contacts 37, 39 and the circuit unit 49 compose a switching mechanism for shutting down the power. It is preferable to combine the switching mechanism and a braking device as described below.

With reference to FIGS. 7 through 10, the conductive contacts 37, 39 and supporting members 41, 43. Since the conductive contact 39 is the same as the conductive contact 37 and the supporting member 43 is the same as the supporting member 41, the description will be made as regard only to the respective former and the description about the latter will be omitted. The conductive contact 37 is made by forming a high conductive metal piece into a hook-like configuration and is fitted to a mounting groove 41*c* formed in the supporting member 41. As shown in FIG. 9, a stopper 44 is formed by cutting a portion of the conductive contact 37 and standing the cut portion diagonally backward. The stopper 44 is hooked on an engaging hole 41*h* formed in the supporting member 41. Therefore, a conductive contact 37 is prevented from coming off the supporting member 41.

In FIGS. 7 through 8, the reference numeral 45 designates each spring for pushing the supporting member in the direction toward the inside of the insertion portion 33 (upwardly in this drawing). The distance between the supporting members 41 and 43 pushed by the springs 45, 45 is elastically is increased and decreased. The conductive contact 37 may be formed of high elastic material to also have a function of the spring 45. Between the facing surfaces is fanned out toward the front to have an opening 47. In this structure, the conductive contacts 37 and 39 are separated by inserting a circuit unit 49 (described later) through the opening and the conductive contacts 37 and 39 come into contact with each other again because of the function of the springs 45, 45 by pulling out the circuit unit 49.

With reference to FIG. 3, the circuit unit 49 will be described hereinafter. The circuit unit 49 has one end 49*e* which is recessed and fixed to the insertion portion 33. The circuit unit 49 comprises a casing member 51 of which both ends are opened, a slidable member 53 which is mounted inside the casing member 51 at the front end 51*e* in such a manner that the slidable member is capable of sliding in the longitudinal direction, a circuit substrate 55 mounted to the center of the slidable member 53, and a control switch 59 mounted on the circuit substrate. The control switch 59 is connected to the circuit substrate 55 by a connecting line 60. It should be noted that though the circuit unit is directly inserted into the insertion portion 33 in this embodiment, a cable extension may be disposed between the circuit unit 49 and the insertion portion 33 and have a connector disposed at the end thereof to insert the connector into the insertion. In this case, the operation of the circuit unit 49 can be controlled remotely from the insertion portion 33.

The circuit substrate 55 is provided with a control circuit 57 in which a DC braking mode and a three-phase power shutdown mode, a three-phase power supplying mode, or a subdued DC braking mode are set. Other mode than these modes may be set as needed. The switching among these modes is performed by operating the control switch 59. The DC braking mode is set to brake or stop the spindle motor 12A by applying DC voltage, produced by rectifying three phases (or any two phases) of each three-phase power supply line 35U, 35V, 35W, to the spindle motor 12A. The three-phase power shutdown mode is set to shut down the three-phase AC power to each spindle motor 12A, 12A, . . . The three-phase power supplying mode is set to supply the three-phase AC power to each spindle motor 12A, 12A, . . . The subdued DC braking mode is set to apply DC feeble voltage, produced by rectifying the three phases or any two phases of each three-phase power supply line 35U, 35V, 35W, to the spindle motor 12A to prevent the spindle from rotating involuntarily.

The reason for providing the three-phase power shutdown mode in this embodiment is that a main switch of the inverter power source 26 does not have to be turned off when the power supply to the spindle motors should be shut down for some reason. The reason for providing the three-phase power supplying mode is, for example, that it is convenience for checking the tied yam to rotate temporarily the spindle motor. The spindle motor 12A is rotated just by pulling out the circuit unit 49 from the insertion portion 33. However, there is a case that the spindle motor has to be stopped soon by inserting the circuit unit 49 due to faulty tying. It is troublesome to pull out and insert the circuit unit many times. In such a case, the three-phase power shutdown mode is used to temporarily rotate the spindle motor, thereby solving such trouble. The reason for providing the subdued DC braking mode is to efficiently tie a snapped yarn as mentioned above.

The tip 55*e* of the circuit substrate 55 has conducting parts 61, 61 on the both surfaces thereof, respectively as shown in FIG. 7, which come into contact with the conductive contacts 37, 39, respectively (FIGS. 8 and 9). The conducting parts 61, 61 allow the control circuit 57 to be energized. The circuit substrate 55 has a rectifier circuit for rectifying any two phases of the three-phase power supply line 35 and a power circuit 65 having a DC-DC converter circuit, which are incorporated in the circuit substrate 55. A power circuit 63 is provided to supply DC voltage for energizing the spindle motor 12A when the DC braking mode or the subdued DC braking mode is selected. Instead of the power circuit 63, a battery or an external power source may be employed.

Upon inserting the aforementioned circuit unit 49 i.e. the circuit substrate 55 into the insertion portion 33 as shown in FIGS. 7 through 9, the tip 55*e* separates the supporting members 41, 43 (conductive contacts 37, 39) against the biasing forces of the springs 45, 45 so as to shut down the supply of power from the inverter power source 26 to the spindle motor 12A. On the other hand, upon pulling out the circuit substrate 55, the supporting members 41, 43 (conductive contacts 37, 39) separated each other are returned by the biasing forces to come into electrical contact with each other again. This renders power to be applied to the spindle motor 12A to restart the spindle motor 12A.

Shown in FIGS. 21 through 22 is an alternative of the circuit unit 49 composing a part of the switching mechanism. The reference numeral 49*a* in FIG. 21 designates an insulating unit made of synthetic resin. By inserting the insulating unit 49*a* between the conductive contacts 37 and 39, the conductive contacts 37 and 39 are separated from each other to shut down the power (FIG. 21(*a*)), while by puffing out the insulating unit 49*a*, the conductive contacts 37 and 39 are brought in contact with each other to restart to supply the power (FIG. 21(*b*)).

On the other hand, the reference numeral 49*b* designates a switching member which is provided with a metallic terminal (conductive portion) disposed on one end of the insulating unit 49*a* to conduct the front and the back of the insulating unit 49*a*. The metallic terminal 49*d* and the other portion (insulating portion 49*c*) are selectively brought in contact with the conductive contacts 37, 39 by sliding the switching member between the conductive contacts 37 and 39. That is, power is supplied when the metallic terminal 49*d* is in contact with the conductive contacts 37, 39 and power is shut down when the insulating portion 49*c* is in contact with the conductive contacts 37, 39. In this embodiment, the switching member 49*b* is allowed to be pulled out between the conductive contacts 37 and 39 and the conductive contacts 37 and 39 are in electrical contact with each other when the switching member 49*b* is pulled out.

The switching mechanism shown in FIG. 23 generally comprises the pair of conductive contacts 37, 39 and a rotary switching member 49*f* disposed between the conductive contacts 37 and 39. By rotating the rotary switching member 49*f* in the direction of the arrow shown in FIG. 23, insulating portions 49*g*, 49*g* and a conductive portion 49*h* can be selectively brought in contact with the conductive contacts 37, 39.

With reference to FIGS. 4 through 6 as well as FIG. 1, the control unit 13A will be described. The control unit 13A has a housing duct (casing) 67 and three-phase buses (copper bars) 69 35 which are embedded in the housing duct 67. The three-phase buses 69 forms apart of the three-phase power supply line 35. The housing duct 67 is made of insulating material such as plastic and comprises a substrate 67, a patch 73, and a cover 75. The substrate 67 has 4 parallel and straight grooves $67b_1$ through $67b_4$, into which the buses 69 are embedded, formed in the longitudinal direction thereof. The buses 69 and an earth 71 are embedded in the grooves $67b_1$ through $67b_4$ and are covered by the patch 73. In addition, the patch 73 is covered by the cover 75. The configurations of the grooves $67b_1$ through $67b_4$ may be devised to prevent the three-phase buses 67 and the earth 71 from coming off so that the patch 73 may be omitted.

It is preferable that the buses 69 and the earth 71 have respective parts facing (exposed) outside the housing duct 67. The spindle motor 12A is energized by wires 74 fixed to the exposed faces 69*o* and 71*o*. According to the present invention a series of housing ducts are formed, by connecting several housing ducts each of which is connected to two spindles 9, 9, for every fixed number of spindles (herein 24 spindles) wherein the fixed number is suited for the configuration of the ring spinning frame 1A.

Hereinafter, the electric circuit will be described according to FIGS. 11 and 12. A control circuit 57 shown in FIG.

11 is a circuit for applying DC voltage, produced by rectifying the half waves of and controlling three-phase AC phases supplied from the three-phase power supply line 35, to the spindle motor 12A. The control circuit 57 is structured as follows. That is, the control circuit 57 comprises a main element circuit 57A performing switching, rectification, and phase control for the three-phase power source, a phase control (ignition control) circuit 57B performing phase and ignition control of each thyristor, and a phase detection circuit 57C used for the phase control.

In the main element circuit 57A, 6 thyristors are used. The supply and shutdown of the three-phase power source are performed by bi-directional thyristors THU1, THV1, and THW1. The three-phase half-wave rectification for producing DC voltage is performed by THU2, THV3, THW1, and THV2. The phase control for varying the value of DC voltage is performed by THU2 and THV3. The reference numeral D1 designates a reflux diode for carrying reflux current.

Figure 12A:
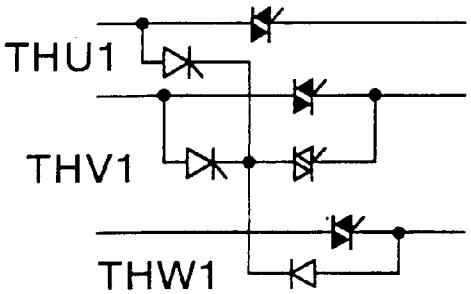
FIGS. 12A, 12B and 12C are circuit diagrams showing mode states, respectively.

The main element circuit 57A shown in FIG. 12(A) is in the condition that the three-phase power supplying mode is selected. When the circuit substrate 55 is inserted into the insertion portion 33, power is supplied to the control circuit 57 through bus-side contact pieces 37U, 37V, 37W and contact pieces 61U, 61V, 61W which are in contact with 37U, 37V, 37W, respectively. In this state, gate signals 57*a* and 57*b* are turned on so that the bi-directional thyristors THU1, THV1 and THW1 serially connected to the three phases U, V and W, respectively are turned on. The three-phase voltage inputted in this manner is outputted through the bus-side contact pieces 37U, 37V and 37W.

Figure 12B:
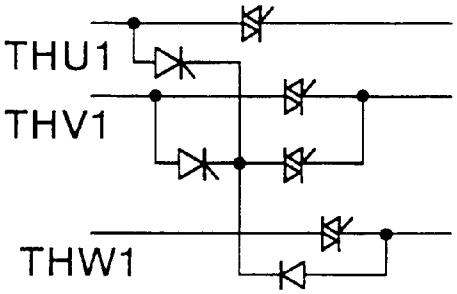

The main element circuit 57 shown in FIG. 12(B) is in the condition that the three-phase power shutdown mode is selected. When the bi-directional thyristors THU1, THV1 and THW1 are turned off so that the gate signals 57*a* and 57*b* are turned on, the inputted three-phase voltage is not outputted to the contact pieces 37U, 37V and 37W. In this case, the thyristor THV2 for rectifier control may be ON or OFF.

Figure 12C:
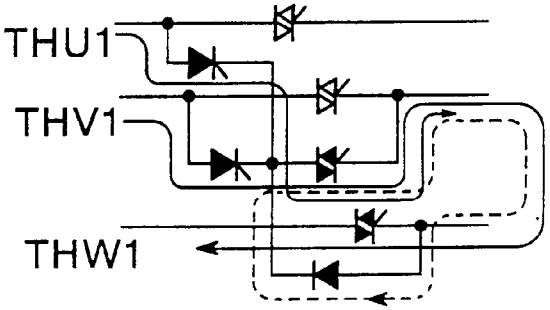

The main element circuit 57A shown in FIG. 12(C) shows is the case that the DC braking mode is selected. The gate signal 57, THU1 and THV1 are OFF. In this state, the gate signals 57*b*, 57*c*, 57*e*, and 57*a* are turned on so as to tun on THV2 for rectifier control, THU2 and THV3 for phase control, thereby forming the three-phase half-wave rectification circuit comprising V phase, U phase and W phase. The spindle motor is braked using DC voltage outputted by the three-phase half-wave rectification circuit.

On the other hand, by delaying the ignition phase of the thyristor THV3 for phase control, the value of DC voltage applied to the spindle motor is decreased, with the result that the braking force is subdued (subdued DC braking mode). In this case, the ignition phase is controlled in such a manner that the DC voltage becomes to the degree to which the spindle motor is prevented form rotating involuntarily. As the voltage is too low, the involuntary rotation of the spindle during the repair working for a snapped yarn interferes the repair working so that it does not go just as you want.

The switching (selection) of the aforementioned modes is performed by operating the mode control switch 59 (see FIG. 3) mounted on the circuit substrate 55 as mentioned above. Though the mode switch is made up of a single switch in this embodiment, the modes may be switched by a plurality of switches or may be automatically switched from one mode to anther mode after elapse of fixed time period, using a timer incorporated therein.

The other modes than the DC braking mode may be omitted so that the control circuit may comprise only the DC braking mode and any one of the other modes. For example, the control circuit may comprise two modes: the DC braking mode and the subdued DC braking mode if necessary (the three-phase power shutdown mode and the three-phase power supplying mode are omitted), or may comprise three modes: the above modes and the three-phase power supplying mode (the three-phase power shutdown mode is omitted). That is, the DC braking mode is necessary and one of the other modes as needed is enough.

(Second Embodiments)

Herein, the second embodiment will be described with reference to FIG. 13. The reference numeral 1B designates a ring twisting frame as one of spinning machine. The basic differences between the ring twisting frame 1B and the ring spinning frame 1A are that the later does not include the draft unit 5 and at the latter is provided with rollers 5*r* for drawing the yarns 6 from the rovings 3, respectively. Besides the above points, there is no difference between the ring twisting frame and the ring spinning frame. Therefore, like parts are given by like reference numerals so as to omit the description about the parts to avoid the repetition. Consequently, there is no difference between the effects given by the ring twisting frame 1B and that of the ring spinning frame 1A.

(Third Embodiment)

Hereinafter, the third embodiment will be described with reference to FIG. 14. The reference numeral 1C designates a two-for-one twister 1C as one of spinning machine. Also in the two-for-one twister 1C, the same technique as the ring spinning frame 1A and the ring twisting frame 1B is employed basically. In the two-for-one twister 1C, spindle motors 12 for rotating spindles 9 as components are controlled by a spindle motor control system A. As shown in FIG. 14, fiber is wound onto a yarn supply package 88 via a winding package 80, a winding drum 82, rollers as a feed roller 84, and a balloon guide. Consequently, there is no difference between the effects given by the two-for-one twister 1C and that of the ring spinning frame 1A.

(Fourth Embodiment)

Figure 15A:
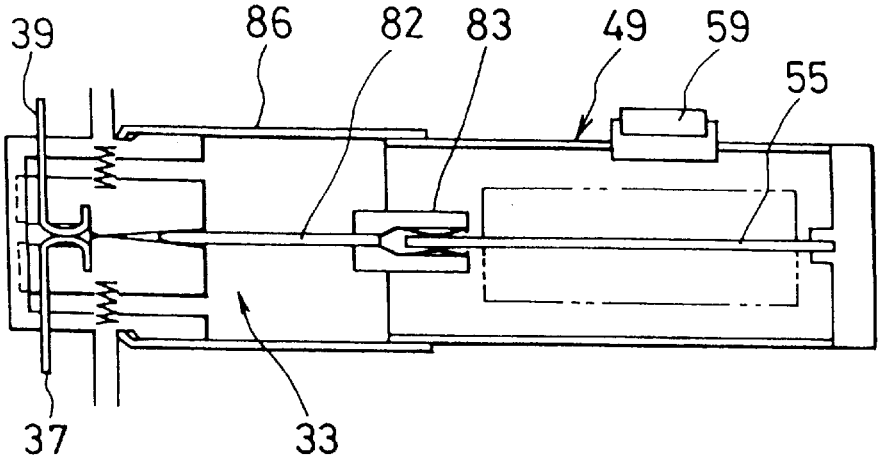
FIGS. 15A and 15B are schematic views showing the fourth embodiment.
Figure 15B:
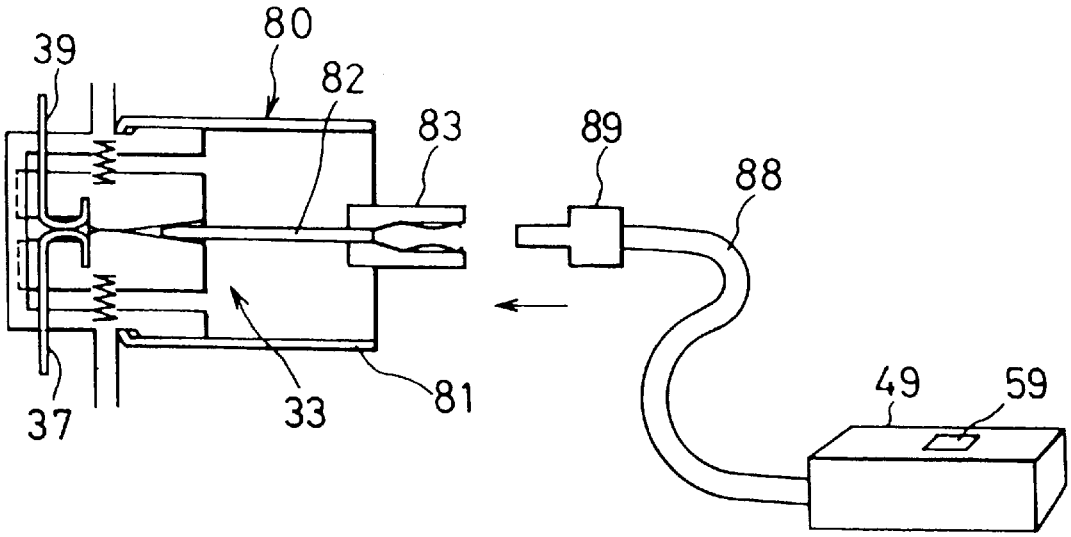

With reference to FIGS. 15(A) and (B), the fourth embodiment will be described. The difference between the fourth embodiment and the first embodiment is that the fourth embodiment has a relay unit which the first embodiment does not have. Hereinafter, the description will be made as regard only to the relay unit 80 and the description about other members will be omitted.

The relay unit 80 is provided to be inserted between the circuit unit 49 and the insertion portion 33 to relay the function of the circuit unit 49. The main advantage of providing the relay unit 80 is that the spindle motor 12 can be stopped without inserting the circuit unit 49 as mentioned above. The relay unit 80 is structured as follows. That is, the relay unit 80 comprises a hollow casing 81, a relay substrate 82 incorporated in the hollow casing 81, and a relay connector mounted on the rear end of the relay substrate 82. The hollow casing 81 is configured to be bigger than the circuit unit 49 so as to allow the circuit unit 49 to be inserted into the hollow casing 81. The front end of the relay substrate is structured to be inserted between the supporting members 41, 43 (conductive contacts 37, 39), like the tip 55*e* of the circuit substrate 55. The open end of the relay connector 83 is structured to allow the circuit substrate 55 of the circuit unit 49 to be inserted into the open end, like the supporting members 41, 43.

With reference to FIG. 16, the structure of the relay connector 83 will be described. The relay connector 83 has a pair of supporting parts 84, 84 and a pair of conductive contacts 85, 85 caught between the supporting parts 84, 84. The relay substrate 82 is fixed by inserting the relay substrate 82 from one side (left side in the drawing) into the relay connector 83. At this point, the conductive contacts 85, 85 are brought in electrical contact with the conductive faces 82*a*, 82*a* of the relay substrate 82 so as to come into indirect contact with the conductive contacts 37, 39 of the insertion portion 33, respectively. The conductive contacts 85, 85 are formed by high elastic material so as to elastically deform as shown by the arrows when the circuit substrate 55 of the circuit unit 49 is insert thereto and pulled off therefrom and to come in electrical contact with conductive faces 55*a*, 55*a*. This allows the electrical contact between the circuit substrate 55 and the conductive contacts 37, 39 of the insertion portion 33 to control (brake) the spindle motor 12A.

The open ends of the conductive contacts 85, 85 in the state where the circuit substrate 55 is not insert are separated from each other and are not in electrical contact with each other as shown in FIG. 16. Therefore, upon inserting the relay unit 83 in this state, the conductive contacts 37, 39 of the insertion portion 33 are separated from each other to shut down the power to the spindle motor 12A. In this case, the relay unit 83 functions as an insulating unit for shutting down the power. In case of using the relay unit 83 as the insulating unit, the relay unit 83 is insert alone to shut down the power and the involuntary stopping of the spindle motor 12A is waited to tie the yarn 6.

Returning to FIG. 15, an alternative of the fourth embodiment win be described. The alternative is characterized by comprising a cable extension 88 electrically connected to the circuit unit 49 (circuit substrate 55) and a connector 89 connected to the open end of the cable extension 88. The cable extension 88 and the connector 89 allow the spindle motor 12A to be controlled remotely from the insertion portion 33. The circuit unit 49 of the alternative preferably comprises a closed casing instead of a hollow casing. This prevents accidents such as short of the circuit substrate 55 due to dusts or an alien substance. For the connector, any exit appearance which can allow sufficient electrical contact with the conductive contacts 85, 85 and allow the connector to be inserted and pulled out is enough.

(Fifth Embodiment)

Hereinafter, the fifth embodiment of the present invention will be described with reference to FIG. 17. The reference numeral 100 designates a braking device mounted on each spindle motor 12. The braking device 100 generally comprises following members. That is, the braking device 1 generally comprises a operational lever 101 which is pushed down by a hand of an operator, a supporting member 102 supporting the operational lever 101 to allow the operational lever 101 to move up and down, a projection 103 projecting from a lower surface of the operational lever 101, and two brake arms 110, 111. An end 103*a* of the projection 103 is configured in a gentle conical shape so that when pushing down the operational lever 101, the end of the projection 103 comes in contact with cam faces 111, 113 (described later) of the brake arms 110, 112 to widen a space therebetween. In the braking device 100, as shown in FIG. 18, the spindle is caught by the brake arms 110, 112. The braking device 100 is structured in such a manner that, as needed, the spindle blade is applied with equal-braking forces from the both side, that is, toward the axis.

The brake arms 110, 112 are each formed in S-like configuration as shown in FIG. 18. The brake arms 110, 112 have ends 110*a*, 112*a* which are rotatably secured to a pivot axis 114 and guide holes 116, 117 formed on the way thereof through which a movable shaft 115 is passed so that the brake arms 110, 112 is movable along the guide holes 116, 117. Fixed on the upper end of the movable shaft 115 is the supporting member 102. The brake arms 110, 112 are provided with the aforementioned tapered cam faces 111, 113, respectively, at the open ends 110*b*, 112*b*. The brake arms 110, 112 are provided with friction pieces 118, 118 mounted on the inner peripheries and coil springs 119, 119 mounted on the external peripheries thereof to exert forces in such a direction that the brake arm 110 and the brake arm 112 are separated. In this state, the spring forces of the coil springs 119, 119 are exertion the cam face 111 and cam face 113 in such a direction of pulling each other.

The operation of the fifth embodiment is as follows. When the insulating unit is inserted to the power supply line to shut down the power and the operational lever 101 is pushed down by the hand of the operator, the operational lever 101 becomes in a state as shown by virtual lines in FIG. 17 because of the function of the supporting member 102. In this state, the end of the projection comes in contact with the cam faces 111,113. The state in which the end is in contact with the cam faces 111, 113 is shown by solid lines in FIG. 19. The state in which the operational lever is further pushed down is shown by virtual lines in FIG. 19. In this state, components of force of the projection end 103*a* are exerted on the cam faces 111, 113 to increase the spacing between the open end 110*b* of the brake arm 110 and the open end 112*b* of the brake arm 112 against the spring forces of coil springs (biasing means) 119, 119. Then the movable shaft 115 is guided along the guide holes 116, 117, with the result that the brake arms 110 and 112 pivot about the pivot axis 114 so that the friction pieces 118, 118 come close to each other to brake the spindle 9*s*.

Since the friction pieces 118, 118 are, as shown in FIG. 18, structured to come in contact with the spindle blade equally toward the axis of the spindle blade, the braking forces are equably exerted on the spindle blade without difference in baking force between both sides thereof. To release the braking, just taking the hand off the operational lever 101 is enough. Because of the function of the coil spring 119, 119, the cam faces 111, 111 are brought close to each other to push up the projection end 103*a*. Therefore, the operational lever 101 return to the original position automatically. It should be noted that though the coil springs are employed as biasing means in the fifth embodiment, the invention is not limited to this. Any one capable of biasing the brake arms 110 and 112 in the widening direction (in such a direction as to move apart from the spindle) is enough. For example, if the friction pieces 118 and the brake arms 110, 112 have elastic structures, these function as biasing means. In this case, the frictional pieces 118 deform when coming in contact with the spindle and elastically return to increase the spacing between the brake arms 110, 112 when exerted with no external force for braking.

(Sixth Embodiment)

FIG. 19 shows the sixth embodiment. The sixth embodiment may exhibit basically the same effect as the fifth embodiment. The fifth embodiment is characterized in that the braking of the spindle blade is performed by grasping handles 111, 111 of the braking device which is configured like a pair of pliers, while the braking is performed by pushing down the operational lever in the fifth embodiment. Also in this case, the coil springs 119 function as biasing means. Like the fifth embodiment, the coil springs 119 maybe eliminated the friction pieces 118 may be used as the biasing means.

(Seventh Embodiment)

Based on FIG. 24 and FIG. 25, the seventh embodiment of the present invention will now be described. In this embodiment, the opening and closing of the switching mechanism corresponds to the braking and release of the braking device. The combination of the switching mechanism and the braking device of which operations correspond to each other may be freely designed. FIG. 24 shows the combination of the switching mechanism shown in FIG. 22 and the mechanical braking device shown in FIG. 17. To avoid the repetition, like parts are given by like reference numerals so as to omit the description about the parts.

The switching member 49*f* is fixed to the lower end of the central portion of the operational lever 101 and the switching member 49*b* is structured so as to slide between the conducive contacts 37 and 39 when the operational lever 101 is moved to pivot about the supporting member 102. In this embodiment, the insulating portion 49*c* of the switching member 49*f* is in contact with the conductive contacts 37, 39 so that the switching mechanism is opened when the operational lever 101 is pulled upward, and the conductive portion 49*d* is in contact with the conductive contacts 37, 39 so that the switching mechanism is closed when the operational lever 101 is pushed downward. The projection 103 operates the brake arms 112 to brake the spindle 9*s* corresponding to the upward movement of the operational lever 101, and releases the braking corresponding the downward movement of the operational lever 101.

The reference numeral 150 in FIG. 24 designates covering members made of synthetic resin fixing the stator windings (shown by dotted lines) of the spindle motor. In this embodiment, the covering members 150 are formed in such a manner that the switching member is fitted to the covering members 150 without losing the functions of the motor casing. The configuration of the covering members 150 is formed to fit the configurations of the switching member and the like.

Instead of the conductive contacts 37, 39, a pair of conductive contacts 37*a*, 39*a* separated from each other as shown in FIG. 25 may be employed. The conduction between the conductive contacts 37*a* and 39*a* is performed by pushing the operational lever 101 downward against the spring force of a spring 101*b* to bring a conductive connecting member 101*a* in contact with terminals of the conductive contacts 37*a* and 39*a*. As the operational lever 101 is released, the operational lever 101 is pushed upward by the spring force of the spring, the connecting member 101*a* is not in contact with them and, corresponding to this, the projection 103 operates the brake arms 112.

The spinning machine according to the present invention exhibits the following effects. First, the number of the circuit substrate can be decreased, thereby decreasing the manufacturing expenses and maintenance/checkout expenses. Second, a long low voltage signal line/low voltage power supplying line is no longer necessary not to catch an undesired signal, thereby stabilizing the operation of the low voltage circuits and thus stabilizing the control of the spinning machine. Finally, the efficiency of the power supply can be increased and the efficiency of the wing can be increased.

I claim:

1. A spinning machine having a spindle motor control system which includes:

a plurality of spindles for drawing long and narrow fibers from a lump of natural fiber or synthetic fiber and twisting the drawn fibers;

a plurality of spindle motors each provided for each spindle, an inverter power source for supplying power to said spindle motors, and three-phase power supply lines for individually connecting said spindle motors and said inverter power source, wherein the spindle motor control system comprises switching mechanisms each of which individually shuts down power of at least two phases of said three-phase power supply line, and braking devices each of which brakes each spindle when each switching mechanism is opened.

2. A spinning machine having a spindle motor control system as claimed in claim 1, wherein each switching mechanism includes a pair of conductive contacts which are in electrical contact with each other and an insulating unit which is allowed to be inserted or pulled out between the pair of conductive contacts, wherein the pair of conductive contacts are separated from each other when the insulating unit is inserted therebetween, and come in contact with each other again after the insulating unit is pulled out.

3. A spinning machine having a spindle motor control system as claimed in claim 2, wherein each braking device includes a fraction piece to be brought in contact with the spindle, a brake arm to which said fraction piece is fixed, an operational lever for bringing the brake arm close to or apart from the spindle, a supporting member for pivotably supporting the operational lever, and biasing means for biasing the brake arm in such a direction as to move apart from the spindle, and the opening and closing of said each switching mechanism corresponds to the braking and release of said braking device.

4. A spinning machine having a spindle motor control system as claimed in claim 2, said braking device includes a brake voltage supplying device for applying braking DC voltage to said spindle motor;

said DC voltage applied by said brake voltage supplying device is produced by rectilying three phases or any two phases of each three-phase power supply line.

5. A spinning machine having a spindle motor control system as claimed in claim 2, wherein stator windings of each spindle motor are fixed by filling synthetic resin materials around the stator windings, and the synthetic resin materials are formed in such a manner that each switching mechanism is partially or entirely fitted to the synthetic resin materials.

6. A spinning machine having a spindle motor control system as claimed in claim 1, wherein each switching mechanism includes a pair of conductive contacts and a switching member slidably disposed between the pair of conductive contacts, wherein said switching member is provided with an insulating portion and a conductive portion which are selectively brought into contact with said pair of conductive contacts by sliding said switching member.

7. A spinning machine having a spindle motor control system as claimed in claim 6, wherein each braking device includes a fraction piece to be brought in contact with the spindle, a brake arm to which said fraction piece is fixed, an operational lever for bringing the brake arm close to or apart from the spindle, and supporting member for pivotably supporting the operational lever, and biasing means for biasing the brake arm in such a direction as to move apart from the spindle, and the opening and closing of said each switching mechanism corresponds to the braking and release of said braking device.

8. A spinning machine having a spindle motor control system as claimed in claim 6, said braking device includes a brake voltage supplying device for applying braking DC voltage to said spindle motor;

said DC voltage applied by said brake voltage supplying device is produced by rectilying three phases or any two phases of each three-phase power supply line.

9. A spinning machine having a spindle motor control system as claimed in claim 6, wherein stator windings of each spindle motor are fixed by filling synthetic resin materials around the stator windings, and the synthetic resin materials are formed in such a manner that each switching mechanism is partially or entirely fitted to the synthetic resin materials.

10. A spinning machine having a spindle motor control system as claimed in claim 1, wherein each switching mechanism includes a pair of conductive contacts spaced from each other and a connecting member for electrically connecting the pair of conductive contacts when closed.

11. A spinning machine having a spindle motor control system as claimed in claim 10, wherein each braking device includes a fraction piece to be brought in contact with the spindle, a brake arm to which said fraction piece is fixed, an operational lever for bringing the brake arm close to or apart from the spindle, a supporting member for pivotably supporting the operational lever, and biasing means for biasing the brake arm in such a direction as to move apart from the spindle, and the opening and closing of said each switching mechanism corresponds to the braking and release of said braking device.

12. A spinning machine having a spindle motor control system as claimed in claim 10, said braking device includes a brake voltage supplying device for applying braking DC voltage to said spindle motor;

said DC voltage applied by said brake voltage supplying device is produced by rectifying three phases or any two phases of each three-phase power supply line.

13. A spinning machine having a spindle motor control system as claimed in claim 10, wherein stator windings of each spindle motor are fixed by filling synthetic resin materials around the stator windings, and the synthetic resin materials are formed in such a manner that each switching mechanism is partially or entirely fitted to the synthetic resin materials.

14. A spinning machine having a spindle motor control system as claimed in claim 1, wherein each braking device includes a fraction piece to be brought in contact with the spindle, a brake arm to which said fraction piece is fixed, an operational lever for bringing, the brake arm close to or apart from the spindle, a supporting member for pivotably supporting the operational lever, and biasing means for biasing the brake arm in such a direction as to move apart from the spindle, and the opening and closing of said each switching mechanism corresponds to the braking and release of said braking device.

15. A spinning machine having a spindle motor control system as claimed in claim 1, said braking device includes a brake voltage supplying device for applying braking DC voltage to said spindle motor;

said DC voltage applied by said brake voltage supplying device is produced by rectilying three phases or any two phases of each three-phase power supply line.

16. A spinning machine having a spindle motor control system as claimed in claim 1, wherein said DC voltage applied by said brake voltage supplying device is produced by rectifying three phases or any two phases of each three-phase power supply line.

17. A spinning machine having a spindle motor control system which includes:

a plurality of spindles for drawing long and narrow fibers from a lump of natural fiber or synthetic fiber and twisting the drawn fibers;

a plurality of spindle motors, a motor provided respectively for each spindle, an inverter power source for supplying power to said spindle motors, and three-phase power supply lines for individually connecting said spindle motors and said inverter power source, wherein each three-phase power supply line is provided with a pair of conductive contacts electrically connected to at least two phases on the way thereof, said pair of conductive contacts are structured to allow a circuit unit to be inserted and pulled out therebetween, said circuit unit has a DC braking mode and at least one of three modes: a three-phase power shutdown mode, three-phase power supplying mode, and a subdued DC braking mode set therein, the DC braking mode or one of said at least one of three mode(s) being allowed to be selected by operating a control switch; wherein the circuit unit is structured in such a manner as to brake each spindle motor by applying DC voltage produced by an external or internal braking voltage supplying device to the spindle motor when the DC braking mode is selected;

as to shut down three-phase AC power to the spindle motor when the three-phase power shutdown mode is selected;

as to supply three-phase AC power to the spindle when the three-phase power supplying mode is selected; and as to apply subdued DC voltage, produced by said braking voltage supplying device, to the spindle motor to prevent the stopped spindle from rotating involuntarily when the subdued DC braking mode is selected; and wherein when the circuit unit is inserted between the pair of conductive contacts to separate the pair of conductive contacts, the circuit unit is actuated, while after the circuit unit is pulled out, said pair of conductive contacts come in contact with each other again.

18. A spinning machine having a spindle motor control system as claimed in claim 17, wherein said braking voltage supplying device produces said DC voltage and said subdued DC voltage by rectifying three phases or any two phases of each three-phase power supply line.

19. A spinning machine having a spindle motor control system as claimed in claim 17, wherein stator windings of each spindle motor are fixed by filling synthetic resin materials around the stator windings, and the synthetic resin materials are formed in such a manner that the pair of conductive contacts are fitted to the synthetic resin materials.

20. A spinning machine having a spindle motor control system which includes:

a plurality of spindles for drawing long and narrow fibers from a lump of natural fiber or synthetic fiber and twisting the drawn fibers;

a plurality of spindle motors, a motor being provided respectively for each spindle, an inverter power source for supplying power to said spindle motors, and three-phase power supply lines for individually connecting said spindle motors and said inverter power source, wherein each three-phase power supply line comprises three-phase buses connected to said inverter power source and distributing lines connecting said three-phase buses and each of said plurality of spindle motors, and at least said three-phase buses are embedded in a casing made of insulting material and partly exposed from said casing, and each three-phase bus exposed from said casing is provided with a detachable terminal for allowing each distributing line to be attached or detached to the three-phase bus.

21. A spinning machine having a spindle motor control system which includes:

a plurality of spindles for drawing long and narrow fibers from a lump of natural fiber or synthetic fiber and twisting the drawn fibers;

a plurality of spindle motors each provided for each spindle, an inverter power source for supplying power to said spindle motors, and three-phase power supply lines for individually connecting said spindle motors and said inverter power source, wherein the spindle motor control system comprises switching mechanisms each of which individually shuts down power of at least two phases of said three-phase power supply line, and braking devices each of which brakes each spindle when each switching mechanism is opened, said each braking device includes a fraction piece to be brought in contact with the spindle, a brake arm to which said fraction piece is fixed, an operational lever for bringing the brake arm close to or apart from the spindle, a supporting member for pivotably supporting the operational lever, and biasing means for biasing the brake arm in such a direction as to move apart from the spindle, each three-phase power supply line comprises bare three-phase buses connected to said inverter power source and distributing lines for connecting the bare three-phase buses and each spindle motor, at least said three-phase buses are disposed in a casing apart from each other at predetermined spaces, and each three-phase bus exposed from said casing is provided with a detachable terminal for allowing each distributing line to be attached or detached to the three-phase bus.

* * * * *